US012740632B2

(12) United States Patent
Hbaich et al.

(10) Patent No.: US 12,740,632 B2
(45) Date of Patent: Sep. 22, 2026

(54) SYSTEMS AND METHODS FOR HAIR COSMETIC APPLICATIONS AND IMPROVEMENTS

(71) Applicant: L'Oreal, Paris (FR)

(72) Inventors: Ayoub Hbaich, Franklin Park, NJ (US); Rafael Feliciano, New Providence, NJ (US)

(73) Assignee: L'Oreal, Paris (FR)

( * ) Notice: Subject to any disclaimer, the term of this patent is extended or adjusted under 35 U.S.C. 154(b) by 19 days.

(21) Appl. No.: 18/933,263

(22) Filed: Oct. 31, 2024

(65) Prior Publication Data

US 2026/0114593 A1 Apr. 30, 2026

(51) Int. Cl.
*A45D 44/00* (2006.01)
*A45D 19/02* (2006.01)

(52) U.S. Cl.
CPC ..... *A45D 44/005* (2013.01); *A45D 19/026* (2021.01); *A45D 2044/007* (2013.01)

(58) Field of Classification Search
CPC ..... A45D 44/005; A45D 19/026; A45D 2044/007; A45D 19/0066; A45D 19/012; A45D 2200/058; G01J 3/463; G01J 3/0264; G01J 3/462; G01J 2003/466; G01J 3/46; G01N 21/25
See application file for complete search history.

(56) References Cited

U.S. PATENT DOCUMENTS 10,806,234 B2 10/2020 Miklatzky et al.
10,863,816 B2 12/2020 Miklatzky et al.
2006/0033907 A1* 2/2006 Inzinna, Jr. ..... G01J 3/46 356/45
2018/0080865 A1 3/2018 Godfrey et al.
2018/0310692 A1* 11/2018 Knuebel ..... A45D 44/005
2019/0295272 A1 9/2019 Aksit et al.

FOREIGN PATENT DOCUMENTS

CN 103533449 A 1/2014
WO 2020/232300 A1 11/2020

OTHER PUBLICATIONS

International Search Report and Written Opinion mailed Jan. 20, 2026, issued in corresponding International Application No. PCT/US2025/052837, filed Oct. 28, 2025, 16 pages.

* cited by examiner

*Primary Examiner* — Veronica Martin
(74) *Attorney, Agent, or Firm* — Christensen O'Connor Johnson Kindness PLLC

(57) ABSTRACT

Systems and methods for high-precision, high-accuracy, personalized hair coloring and/or bleaching treatments that are time-sensitive, including machine learning (ML) implementations thereof. A system comprises circuitry configured to compute, based on an initial shade of hair and a desired shade of the hair, a hair treatment modality to at least approximately achieve the desired shade with a time-sensitive application of a cosmetic composition, such as a hair bleaching formula, that correlates with characteristics of the hair and a projected responsiveness of the hair to the treatment. The system can receive data related to a current progress of the bleaching and recompute, based on the in-progress data and the desired shade, the hair treatment modality for accuracy and precision.

15 Claims, 17 Drawing Sheets

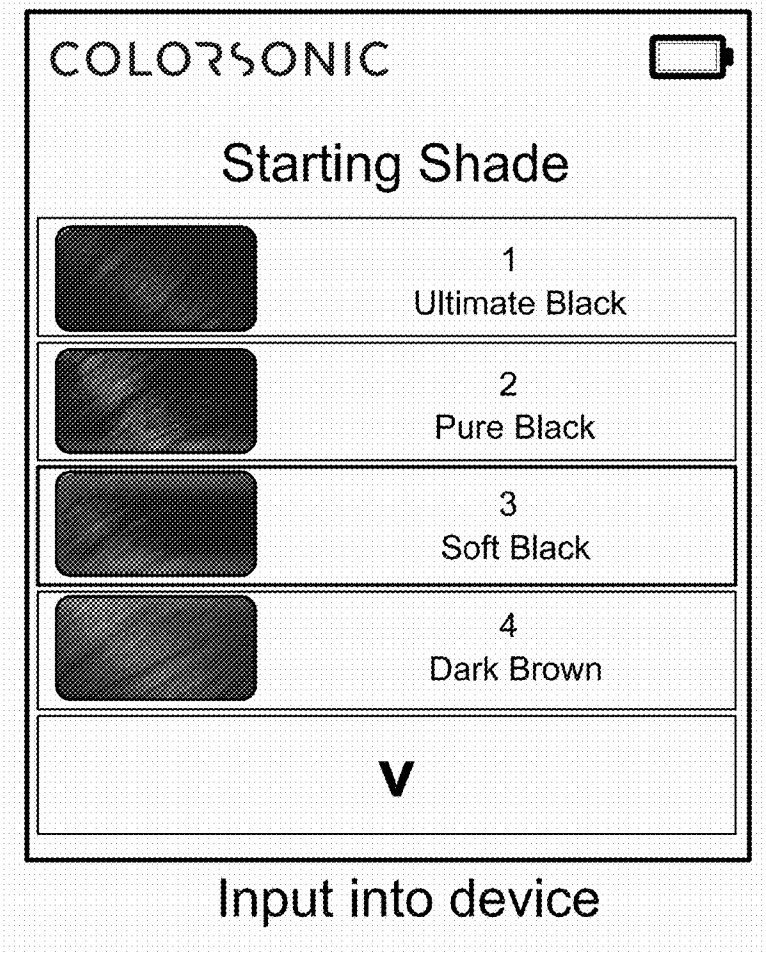
FIG. 4A
(CONT.)
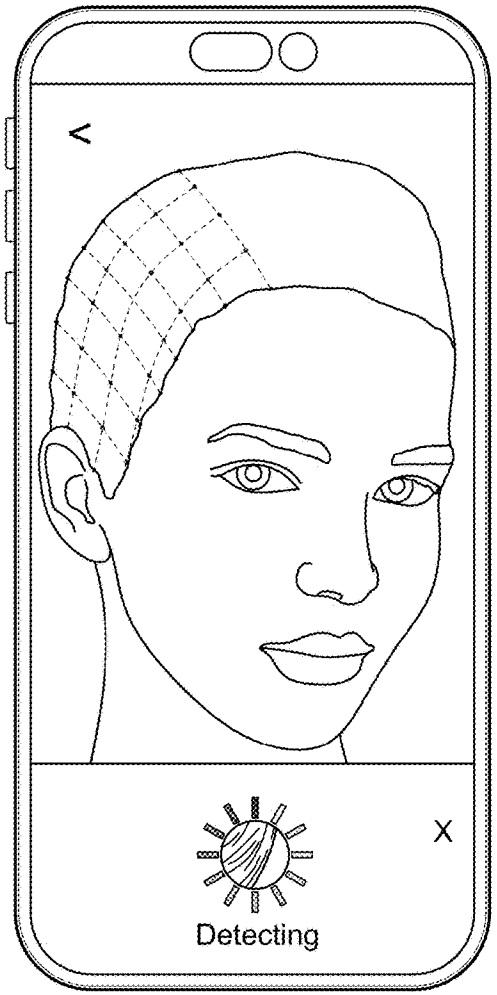
Use the Colorsonic app
21

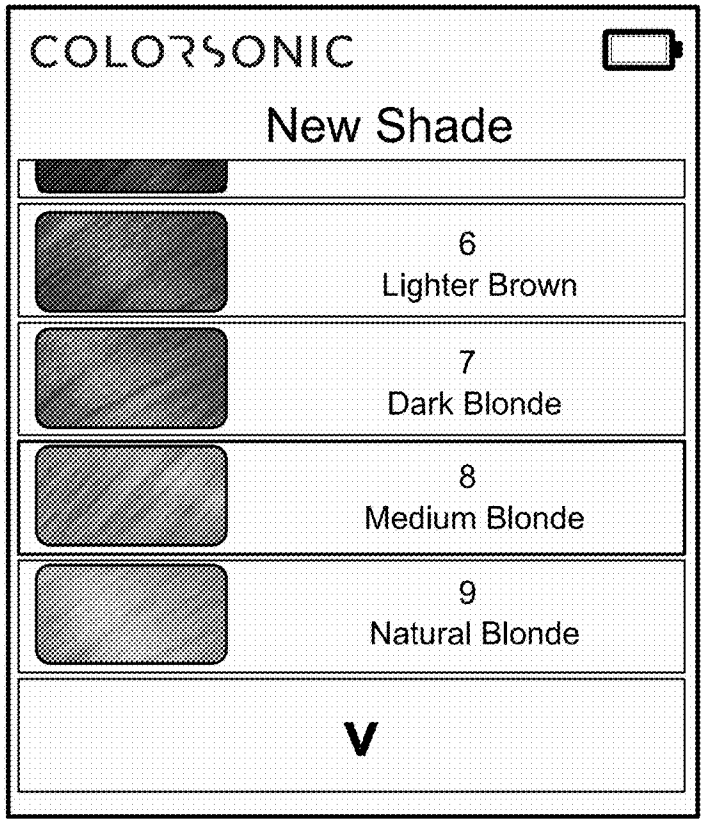
Select straight from device
*FIG. 4A*
*(CONT.)*
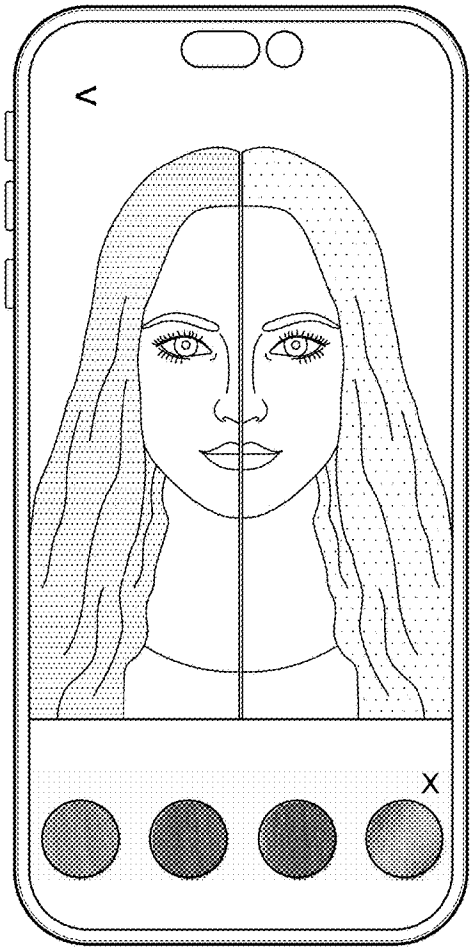
Select new shade
Use the Colorsonic app virtual try-on
21

21

Motor adjustment based on user input

What: Mix ratio control mechanism

How: Separating motors

Why:

- Increase/decrease lifting
- Limit unnecessary hair damage
- Degas developer without wasting dye/powder Bleaching - Greater Lift level

SYSTEMS AND METHODS FOR HAIR COSMETIC APPLICATIONS AND IMPROVEMENTS

SUMMARY

In an aspect, the disclosure provides a system configured to facilitate a time-sensitive application of a cosmetic composition to hair of an individual with a formulation delivery device, the system comprising circuitry configured to: receive an initial hair data set and compute, based on the initial hair data set, an initial shade of the hair of the individual; receive a desired hair data set and compute, based on the desired hair data set, a desired shade of the hair of the individual and compute, based on the initial shade and the desired shade, a hair treatment modality configured to at least approximately achieve the desired shade with the time-sensitive application; and receive an in-progress hair data set and recompute, based on the in-progress hair data set and the desired shade, the hair treatment modality.

In embodiments, the cosmetic composition is a hair bleach composition, a hair color composition, or both.

In embodiments, circuitry is comprised within one computational device.

In embodiments, circuitry is comprised within a plurality of computational devices.

In embodiments, the plurality of computational devices comprises the formulation delivery device and a smartphone device.

In embodiments, the initial hair data set comprises an initial user input that corresponds to a human-mediated visual inspection of the hair of the individual and a human-mediated comparison of the hair with a plurality of reference shades, and wherein the circuitry is configured to compute, based on the initial user input, the initial shade.

In embodiments, the initial hair data set comprises an initial computational input that corresponds to a computational visual inspection of an image of the hair of the individual and a computational comparison of the image of the hair with imagery that corresponds to a plurality of reference shades, and wherein the circuitry is configured to compute, based on the initial computational input, the initial shade.

In embodiments, the desired hair data set comprises a selected user input that corresponds to a human-mediated selection of at least one reference shade of a plurality of reference shades, and wherein the circuitry is configured to compute, based on the selected user input, the desired shade.

In embodiments, the hair treatment modality comprises: a sequence of application steps, a mix ratio of a plurality of formulas of the cosmetic composition, a treatment time, a pause time, a stop time, a hair wetness level, or any combination thereof, wherein the system is configured to display at least a portion of the hair treatment modality for viewing.

In embodiments, the in-progress hair data set comprises an in-progress user input that corresponds to a human-mediated visual inspection of an image of the hair of the individual generated at a pause time of the hair treatment modality, and a human-mediated comparison of the image of the hair of the individual generated at the pause time with imagery that corresponds to a plurality of reference shades, and wherein the circuitry is configured to recompute, based on the in-progress user input, the hair treatment modality.

In embodiments, the in-progress hair data set comprises an in-progress computational input that corresponds to a computational visual inspection of an image of the hair of the individual generated at a pause time of the hair treatment modality, and a computational comparison of the image of the hair of the individual generated at the pause time with imagery that corresponds to a plurality of reference shades, and wherein the circuitry is configured to recompute, based on the in-progress computational input, the hair treatment modality.

In embodiments, circuitry of the system comprises a machine learning model that is configured to compute and/or recompute the initial shade, the desired shade, the hair treatment modality, or any combination thereof.

In embodiments, circuitry of the system is configured to generate a graphical user interface (GUI) that displays, on an image or a live video feed of the hair of the individual, an overlay of one or more optional shades on the image or the live video feed of the hair of the individual as a virtual try-on of the one or more optional shades.

In embodiments, circuitry of the system is configured to compute a mix ratio of a plurality of formulas of the cosmetic composition and control an amount of a bleach formula and an amount of a developer formula that are mixed together by the formulation delivery device.

In embodiments, a mix ratio of a plurality of formulas of the cosmetic composition, and a treatment time, are computed by circuitry of the system for avoidance of an inadvertent overapplication and/or underapplication of the cosmetic composition to the hair of the individual by a user via the formulation delivery device.

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

TABLE 1

Figure 1:
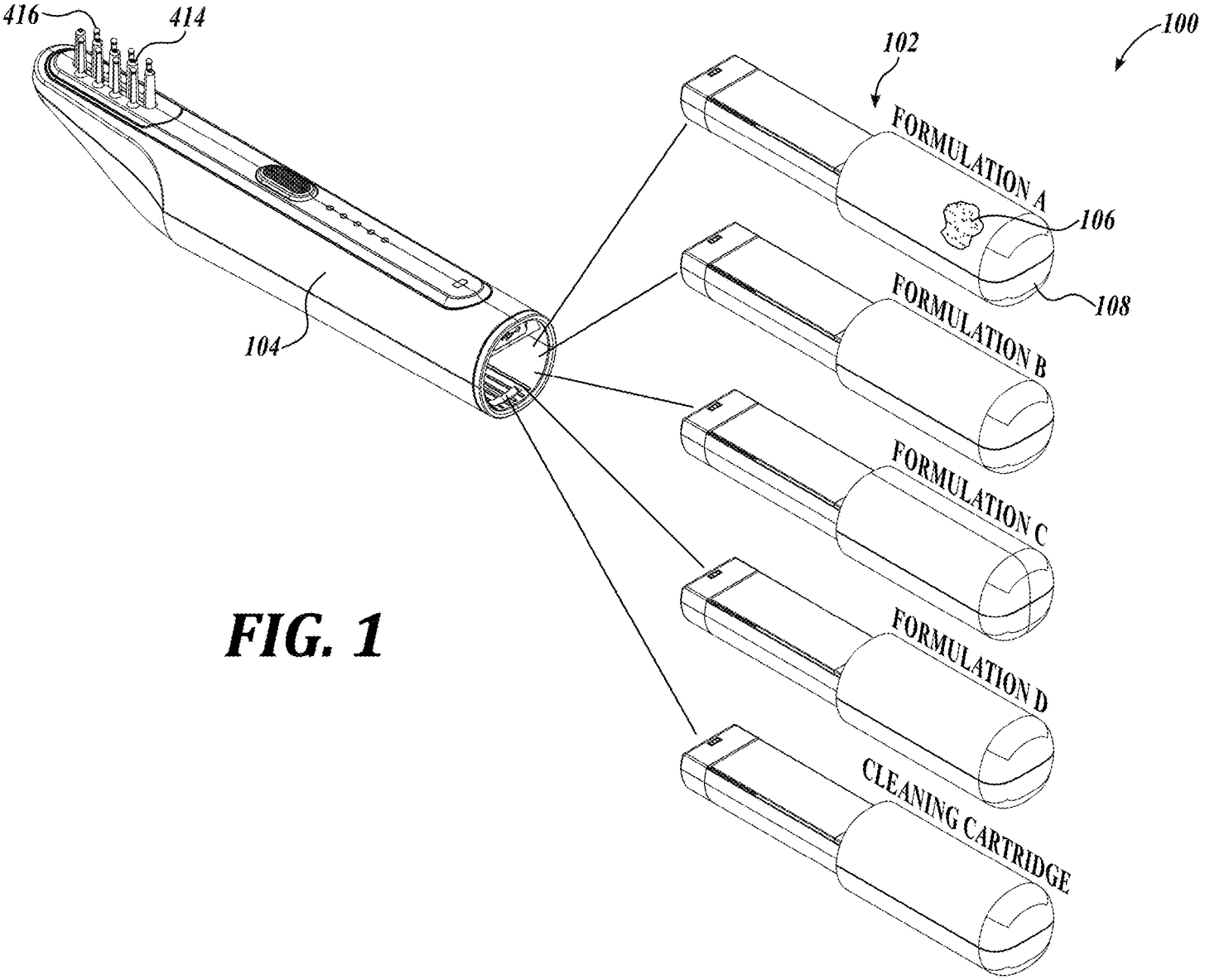
FIG. 1 shows a side perspective view of an example formulation delivery system, according to aspects of the disclosure.

Drawings elements and descriptions.

| Label | Description |
|---|---|
| 1 | Personalized application of cosmetic composition to hair of an individual |
| 2 | Computer vision analysis of hair, automated data entry |
| 3 | Self-analysis of hair, manual data entry |
| 4 | Initial/desired/in-progress hair data (input) |
| 5 | Software application (e.g., mobile application ("app")) |
| 6 | Linear regression (e.g., machine learning) |
| 7 | Hair treatment modality (output) |
| 8 | Application of bleach formula according to modality |
| 9 | Graphical user interface (GUI) |
| 10 | Hair diagnostic evaluation |
| 11 | Shade detection and selection |
| 12 | Virtual try-on for desired shade and hair technique |
| 13 | Personalized application procedure |
| 14 | Bleach formula |
| 15 | Device operational parameter |
| 16 | Sensor data-mediated adjustment of hair treatment modality |
| 17 | Machine learning |
| 18 | Hair color progress/update |
| 19 | In-progress shade analysis |
| 20 | Sensor data for adjustment of machine learning model |
| 21 | Steps of an example process for personalized application of a cosmetic composition |
| 100 | Formulation delivery system |
| 102 | Formulation product line |
| 104 | Formulation delivery device |
| 106 | Formulation |
| 108 | Formulation cartridge |
| 414 | First side of outer tube |
| 416 | Second side of outer tube |
| 200 | Formulation cartridge |
| 202 | Handle portion |
| 203 | First half |
| 204 | Second half |
| 206 | Liquid reservoir |
| 208 | Output nozzles |
| 210 | Front body portion |
| 212 | Refill unit |

The foregoing aspects and many of the attendant advantages of this disclosure will become more readily appreciated as the same become better understood by reference to the following detailed description, when taken in conjunction with the accompanying drawings.

DETAILED DESCRIPTION

Hair bleaching compositions are used by consumers and professionals in the cosmetic industry, e.g., at salons, to lighten, or "lift", the hair shade of an individual from a darker shade to a lighter shade. Examples of hair color include blonde, red, brown, and black, each of which can exist across a spectrum of hair types and a spectrum of lighter and darker hair shades. By bleaching these and other hair colors with hair bleach, the starting hair shade is lifted from a darker (lower number) shade to a lighter (higher number) shade; blonde becomes lighter blonde, red becomes lighter red, brown becomes lighter brown, and black becomes lighter black. The mix ratio of the bleach composition, including a ratio between the bleach agent and developer, combined with concentration of the active ingredients in the cosmetic composition and the time applied to the hair, are factors that impact the speed and extent of the bleaching process. The time-sensitive nature of hair bleaching is associated with much consumer frustration in particular, since obtaining a desired bleaching shade typically requires a precise stopping point for the bleaching process, and this can be difficult to identify by professionals and non-professionals alike. In addition, different hair types react differently to hair bleaching compositions of different concentrations or mix ratios, further complicating the process.

Due to these and other variables in the process, professionals in the salon and consumers at home often encounter problems with typical bleaching kits and methods, including undesired effects due to under-bleaching and over-bleaching, risk of damage to the hair or scalp, and risk of the added color not lasting a satisfactory period and the need for frequent re-application of the composition. While hair salon professionals have experience and expertise that are typically relied on when they apply hair bleaching compositions, their accuracy and precision remain susceptible to human error.

Accordingly, there is a need for improved devices, systems, kits, and methods that can be easily used, by salon professionals and consumers alike, for high-accuracy and high-precision hair coloring and bleaching. The disclosed approaches address these and other long-felt and unmet needs in the field, and also provide personalized recommendations for achieving a desired hair color change, with an at-home hair bleaching process, that can be based on results with the same or similar hair colors and types and machine learning (ML) approaches.

The disclosed aspects and embodiments can be implemented with one or more computational devices and/or systems in combination with any formulation delivery device or system, however, in particular embodiments, can be implemented with a formulation delivery device or system configured for mixture of multiple formulas, such that a bleach formula and a developer formula can be mixed by the formulation delivery device to produce a cosmetic composition and delivered, by the formulation delivery device, to the hair of the individual for a hair bleaching process. The formulation delivery device or system can be configured for electronic communication with a computational device, such as a smartphone or tablet, for a user-mediated, personalized hair bleach treatment process that coordinates operation of the formulation delivery device or system, is interactive, and is configured for improvement based on historical treatments of the individual and/or other individuals, and any ongoing hair bleaching treatment of the individual, i.e., real-time improvement.

Figure 2:
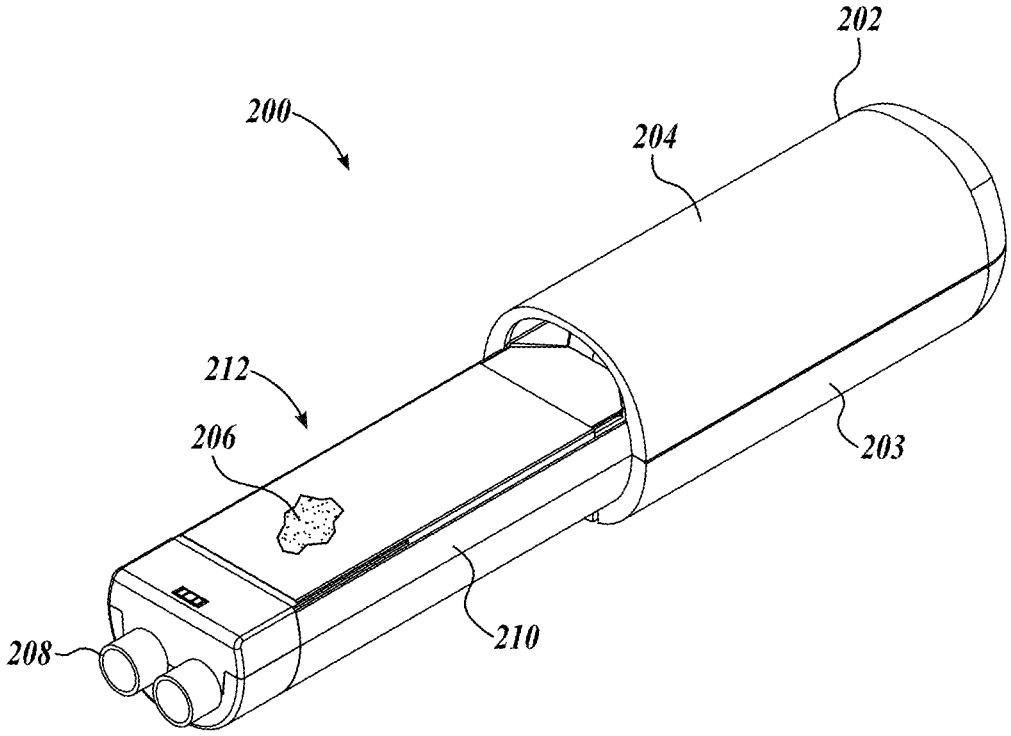
FIG. 2 shows a rear perspective view of an example formulation cartridge, according to aspects of the disclosure.

A formulation delivery system can be configured for compatible use with any of a plurality of formulation cartridges. By way of a non-limiting example, FIG. 1 shows a side perspective view of an example formulation delivery system, and FIG. 2 shows a rear perspective view of an example formulation cartridge. A formulation delivery system 100 can include a formulation cartridge 200. The shown formulation delivery system 100 is an example of a formulation delivery system as described in detail in U.S. Patent Application Publication No. US20240172858A1, published May 30, 2024, and assigned to L'Oreal, which is incorporated by reference herein in its entirety for all purposes. However, it is to be understood that aspects and embodiments of the present disclosure can be used with any formulation delivery system for hair coloring and/or hair bleaching, without departing from the scope and spirit of the disclosure.

The shown example formulation delivery system 100 includes a formulation product line 102, a formulation delivery device 104, and a formulation 106 (e.g., within a liquid reservoir 206 of a formulation cartridge 108, shown as a cutaway view within FIGS. 1-2), which together enable application of a cosmetic composition to the hair of an individual for a personalized hair treatment experience, such as hair coloring and/or bleaching. Formulation product line 102 includes formulation cartridges 108, and formulation cartridges 108 can be of a same (or common) cartridge type configured for interchange and use with the formulation delivery device 104.

The formulation product line 102 can include a cosmetic composition as a hair bleaching formulation, which can include a bleach formula and a developer formula which, when mixed together by the formulation delivery device 104, form the cosmetic composition to be applied to the hair of an individual. In embodiments, a formulation product line 102 can comprise one or more cartridges that comprise: a bleach formula and a developer, a permanent hair dye and a developer, a semi-permanent hair dye and a developer, a shampoo, a conditioner, a hair growth treatment such as minoxidil, a hair protein treatment, a disulfide bond repairing hair treatment, a fluid scalp treatment, or the like.

In embodiments, a formulation product line 102 can include a cleaning cartridge comprising a cleaning solution therein for cleaning the formulation delivery device 104 before and/or after use. A cleaning solution can enable an individual to clean the formulation delivery device 104 by executing a cleaning routine, with the device and the cleaning solution cartridge, that flushes a cleaning liquid (e.g., water, saline) from the cleaning cartridge through fluid conduits of the formulation delivery device 104. This removes residual formulation from the formulation delivery device 104. Advantageously, the cleaning cartridge and cleaning routine enable a significant portion of the formulation delivery device 104 to be reused for different formulations, thereby reducing waste and cost. The cleaning cartridge can include a refillable cleaning liquid reservoir disposed inside the outer housing, which is fluidically connected to the plurality of output nozzles. Thus, a user can fill the cleaning liquid reservoir with a cleaning liquid such as water, execute a number of cleaning routines on the formulation delivery device 104, and refill the cleaning liquid reservoir.

The shown formulation cartridge 108 has an elongate shape and dimensions configured for insertion into a handle of the formulation delivery device 104, in particular into a cartridge cavity of the handle, for mixing and dispensing the cosmetic composition from the formulation delivery device 104. All or substantial portions of a formulation cartridge 108 can be comprised of one or more recyclable elements, for example, for managing the environmental impact of the system and product line.

The formulation cartridge 108 can comprise a plurality of liquid output nozzles, which are sized and positioned at a distal (forward) end of the formulation cartridge 108 in a configuration that fluidically connects with a corresponding plurality of liquid inlets (e.g., first formulation inlets) of the formulation delivery device 104. In embodiments, the liquid output nozzles are valves of formulation vessels (e.g., pouches or packets) disposed in formulation cartridge 108.

FIG. 2 shows a formulation cartridge 200 which is compatible with any of the formulation delivery systems, formulation delivery devices, and formulation product lines described herein. However, the formulation delivery systems, formulation delivery devices, and formulation product lines described herein are not necessarily required to use the sustainable formulation cartridge 200 shown in FIG. 2.

In embodiments, the formulation cartridge 200 is sustainable and is designed to reduce waste and environmental impact, while delivering a user-friendly experience. It includes two main components: a handle portion 202 and a disposable formulation cartridge refill unit 212 (hereinafter referred to simply as refill unit 212) configured to reversibly slide into the handle portion 202. The formulation cartridge 200 is constructed such that the handle portion 202 can be reused indefinitely and the refill units 212 can be readily replaced after depletion of the formulation stored therein. Furthermore, refill unit 212 can be configured to be deconstructed into smaller components, at least some of which can be recycled in embodiments, and others disposed of. Thus, the formulation cartridge 200 utilizes an innovative structure to reduce waste and improve the user experience.

In embodiments, handle portion 202 is sized, dimensioned, and constructed to be repeatedly inserted into the cartridge cavity of the formulation delivery device. Accordingly, handle portion 202 can be formed of a plastic or similar rigid polymer or other material and includes a hollow handle portion 202 configured to receive the refill unit 212 therein. Refill unit 212 includes a refill packet comprising a shell enclosing at least one formulation vessel (e.g., a packet, pouch, or other vessel), for example a first formulation pouch and a second formulation pouch, and a valve frame coupled with the refill packet, e.g., a front body portion 210. In embodiments, at least one formulation vessel is a liquid reservoir 206. The first formulation pouch and second formulation pouch can contain a first formulation (e.g., bleach formula) and a second formulation (e.g., developer formula), respectively. The refill unit 212 can include a packet sleeve. In embodiments, a formulation vessel can comprise a formulation packet and an output nozzle.

In embodiments, the first formulation pouch and second formulation pouch, of the formulation cartridge 200, can each have a volume of about 40 mL to about 70 mL, about 50 mL to about 60 mL, about 40 mL to about 65 mL, about 40 mL to about 60 mL, about 40 mL to about 55 mL, about 40 mL to about 50 mL, about 45 mL to about 70 mL, about 50 mL to about 70 mL, about 55 mL to about 70 mL, about 60 mL to about 70 mL, or about 55 mL. In embodiments, first and second formulation pouches can have different volumes. In embodiments, refill unit 212 stores only one formulation vessel.

In embodiments, the first formulation and second formulation can be independently selected from any of the formulations described herein, or their equivalents in the art, for example, a bleach formula, a permanent hair dye, a semi-permanent hair dye, a developer formula, a conditioner, a hair growth treatment such as minoxidil, a hair protein treatment, a disulfide bond repairing hair treatment, a fluid hair treatment, a fluid scalp treatment, and any combination thereof, or the like. In embodiments, the first formulation and second formulation differ. For example, in some embodiments, the first formulation is a bleach formula and the second formulation is a developer. In other embodiments, the first formulation and second formulation are the same (e.g., a conditioner or scalp treatment formulation).

In embodiments, formulation pouches include a formulation-containing packet and valve means comprising output nozzles 208 for selectively-fluidic coupling the refill unit to a dispensing nozzle unit of a formulation delivery device when the formulation cartridge 200 is received within the hand-held formulation dispensing device. Representative valve means include a valve through which the formulation exits the formulation-containing packet. Example formulation vessels are described in International Patent Application Publication No. WO2019067336A2, published Apr. 4, 2019, and assigned to L'Oreal S A, and U.S. Patent Application Publication No. US20210196021A1, published Jul. 1, 2021, and assigned to L'Oreal S A, both of which are hereby incorporated by reference in their entireties for all purposes.

In embodiments, the shell (i.e., outer portion) of the cartridge refill unit 212 has an elongate shape sized to be received within the reusable handle portion 202. The shell encloses and protects the first formulation pouch and second formulation pouch and engages the valve frame (described below). Thus, the shell functions as packaging which protects the formulation pouches during commerce prior to loading into the formulation delivery device.

In embodiments, the shell has a total length between 150 and 250 mm (e.g., 175-225 mm, 185-215 mm, 195-205 mm, or 200 mm) and a maximum cross-sectional dimension of 25-50 mm (e.g., 30-45 mm, 35-40 mm, or 36 mm). The shell has a rear body portion and a slender front body portion 210, e.g., a neck portion, extending away from the body portion. The body portion and the slender front body portion 210 generally align in a common longitudinal direction to enable assembly with the reusable handle portion 202, and to enable insertion into the cartridge cavity of the formulation delivery device. In embodiments, the shell is constructed at least partially from a recyclable or recycled material, e.g., a paper material such as an injection-molded paper material or a die-cut structured paper (e.g., cardboard). In embodiments, the shell is formed from a single piece of injection-molded paper material. In embodiments in which the shell is formed of paper, the paper has a weight between 8-12 points (e.g., 8.5 points, 9.0 points, 9.5 points, 10.0 points, 10.5 points, 11.0 points, or 11.5 points), to impart sufficient stiffness without contributing excess disposable material.

In embodiments, the rear body portion of the shell has a larger cross-sectional dimension than the front body portion 210 when viewed in a plane normal to the longitudinal direction of the formulation cartridge 200. A hump or bulge imparts the larger cross-sectional area of the rear body portion relative to the slender front body portion 210. Advantageously, the hump or bulge enables the use of higher-volume formulation pouches. Additionally, the hump or bulge forms an abutment which abuts a corresponding interior face of the handle portion 202 and secures the longitudinal position of the shell during use, for example, by friction fit.

In embodiments, the slender front body portion 210 of the shell is sized to fit within the handle portion 202 and to project into the cartridge cavity of the formulation delivery device during use. The front body portion 210 couples with the valve frame. To facilitate secure connection and alignment with the valve frame, the front body portion 210 includes valve frame coupling means, for example at least one coupling tab configured to selectively engage the valve frame. In the illustrated embodiment, the front body portion 210 includes a single coupling tab extending away from a front end thereof. The coupling tab includes an engagement feature, for example a detent or raised prominence shaped and sized to engage a complementary aperture of the valve frame.

In embodiments, the shell can have any of various different configurations. For example, the shell can be a clamshell configuration formed with at least two partial shells (in this embodiment, first half 203 and second half 204) hingedly coupled. In embodiments, the shell includes a different number of partial shells, e.g., three or four partial shells which come together to enclose the formulation pouches. In still other embodiments, the shell comprises a single piece forming an open-ended tube into which the formulation pouches can be inserted. Alignment of the first half 203 and second half 204 enables correct attachment of the front body portion 210 to the valve frame.

While the illustrated shell is formed of an injection molded paper material, this construction is an example and is not limiting. In embodiments, the shell is formed of a single piece of die-cut paper stock, which is folded to impart a three-dimensional structure having the rear body portion and slender front body portion 210 extending away therefrom. In embodiments, this folded construction creates a polygonal cross section in the rear body portion and a polygonal cross section in the front body portion 210 (for example, octagonal and hexagonal cross sections, respectively). To facilitate assembly, embodiments of the shell include one or more scores or guidelines that ensure correct folding. Embodiments have a triangular, rectangular, pentagonal, hexagonal, heptagonal, octagonal, or other polygonal cross-sectional shape.

In embodiments, a packet sleeve can slide over the front body portion 210 and provide several important advantages. First, it imparts additional structure to the refill unit 212 by sliding over and reinforcing front body portion 210. Accordingly, in embodiments, packet sleeve has a greater weight or thickness as compared to the material that forms the shell; although this is not required. In embodiments, packet sleeve is formed of a recyclable material, which can be the same material as the shell. In embodiments, packet sleeve couples with the valve frame. For example, the packet sleeve can include a plurality of engagement member recesses configured to reversibly couple with engagement members of the valve frame. The packet sleeve can facilitate disassembly of the refill unit 212.

In embodiments, the valve frame provides a rigid structure which aligns the output nozzles 208 for correct fluid interconnection with the fluid conduits of the formulation delivery device. Accordingly, the valve frame can be formed from ABS plastic, HDPE, or another rigid polymer or other material. In embodiments, the valve frame is formed from a same material as the shell. Thus, the shell, formulation pouches, valve frame, and optional packet sleeve form the refill unit 212. In use, refill unit 212 is reversibly couplable with handle portion 202, e.g., by securing means such as coupling tabs on the shell or by friction fit between the refill unit 212 and the handle portion 202.

Figure 3A:
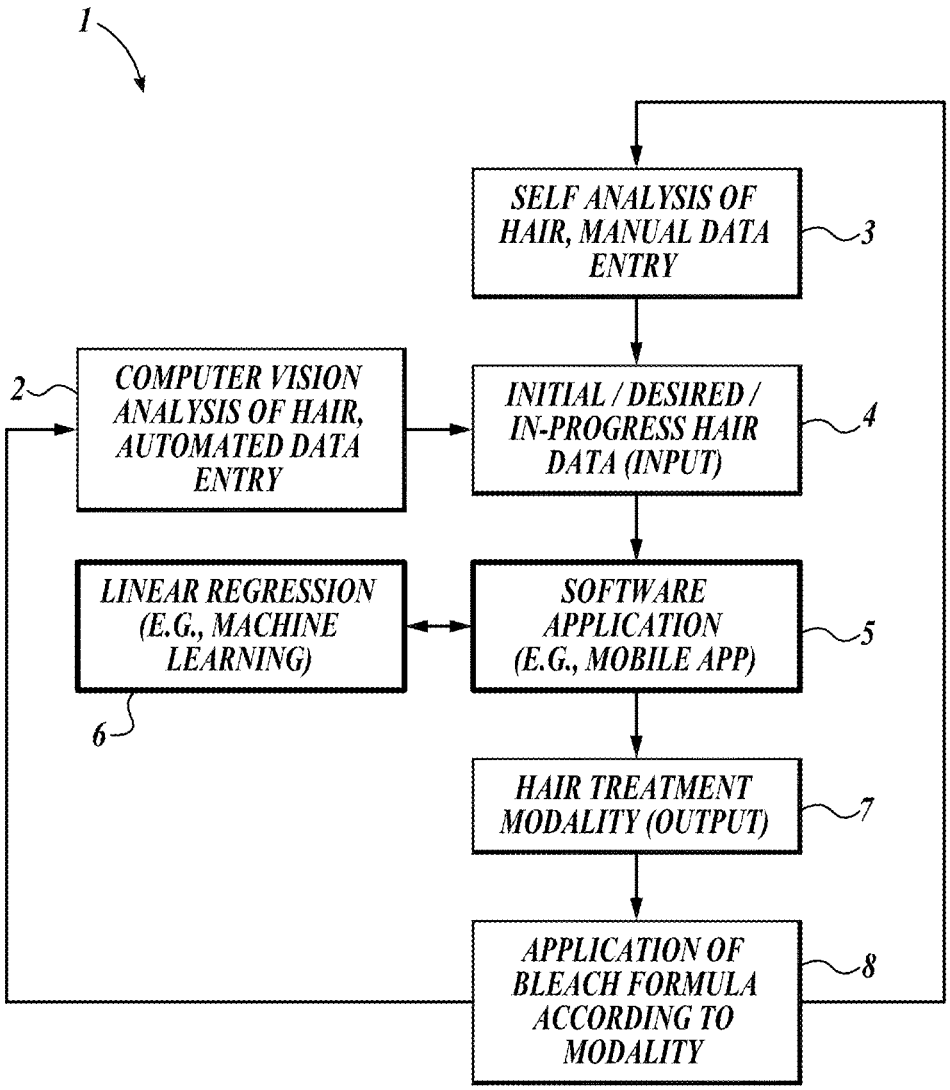
FIG. 3A shows a flow diagram of an example personalized application of cosmetic composition to hair of an individual, according to aspects of the disclosure.

Referring now to FIG. 3A, a flow chart of an example process for personalized application 1 of cosmetic composition to the hair of an individual is shown. In a sense, a software application can configure the system for a user experience that flows from diagnosis of the hair, determination and communication of the treatment modality, monitoring of the application of the hair treatment (e.g., with one or more pause points and one or more in-progress data sets), and re-determination and re-communication of the treatment modality for precise, accurate, and personalized hair treatment. The system intelligently adapts to ongoing hair treatments as well as prior hair treatments, with the same hair or hair that includes one or more similar characteristics, to improve precision and accuracy of the hair treatment process. Such adaptation can occur with implementation of a machine learning model.

As a first starting point in the process, a user can capture imagery of the hair of an individual with a computational device, such as a smartphone camera, and a software application (e.g., a "mobile app"), for example, as executed by one or more processors of the computational device, can perform computer vision analysis of the imagery of the hair, and generate a hair data set for automated data entry 2 into a set of input data. Computer vision analysis of the hair can implement a computer vision algorithm that analyzes the imagery of the hair, computationally detects features of the hair, and computes at least part of a hair data set based on the detected features. In this manner, the hair data set, e.g., an initial hair data set, a desired hair data set, or an in-progress hair data set, can be comprised, at least in part, of data that is automatically generated by the computational device. Accordingly, in embodiments, the initial hair data set comprises an initial computational input that corresponds to a computational visual inspection of an image of the hair of the individual and a computational comparison of the image of the hair with imagery that corresponds to a plurality of reference shades, and wherein the circuitry is configured to compute, based on the initial computational input, the initial shade.

As an additional or alternative approach, an individual or user can perform a manual or self-analysis of the hair, and perform manual data entry 3, as at least part of the hair data set 4. Once the hair data set 4 is generated, by automated 2 and/or manual 3 inputs, it is processed by the software application 5 or a component thereof to compute an initial shade of the hair, a desired shade of the hair, an initial state of a hair treatment modality, and if applicable, an updated state of the hair treatment modality based on an in-progress hair data set. Accordingly, in embodiments, the initial hair data set comprises an initial user input that corresponds to a human-mediated visual inspection of the hair of the individual and a human-mediated comparison of the hair with a plurality of reference shades, and the circuitry is configured to compute, based on the initial user input, the initial shade. With use of the system, the user can select which shade they would like to color their hair to, a desired shade (e.g., as computed from a desired hair data set). As such, in embodiments, the desired hair data set comprises a selected user input that corresponds to a human-mediated selection of at least one reference shade of a plurality of reference shades, and the circuitry is configured to compute, based on the selected user input, the desired shade.

Vision analysis of the hair, whether performed by a computational device, a person, or both, can include determining characteristics of the hair as the data set and communicating the data set to the computational device, or an element thereof, for processing by the software application or a computational component such as a machine learning (ML) model 6. Non-limiting example characteristics of hair that can constitute at least part of a hair data set include initial, desired, and in-progress: hair length, hair thickness, hair type, hair color, hair shade, hair strand density, hair shape, degree of hair straightness or waviness or curliness, as well as a past responsiveness of the same or a similar hair to a hair treatment modality, or the like. At this stage, the user can also select or confirm selection of a desired hair color or shade, and/or the system can suggest a hair color or shade to the user, for example, with a GUI of the software application.

The software application 5, which can be executed in whole or in part by a smartphone or other computational device, can be configured to implement a computational technique, such as linear regression, that correlates characteristics of the hair with hair treatment modalities that produce favorable and/or non-favorable hair bleaching and/or hair color results. For example, hair that is relatively wavy, darker brown, and thicker may be effectively bleached with a first hair treatment modality, and may not be effectively bleached with a second hair treatment modality. On the other hand, hair that is relatively wavy, lighter red, and thinner may not be effectively bleached with the first hair treatment modality, but may be effectively bleached with the second hair treatment modality. In this manner, the results from the visual analysis of the hair, and the desired hair color or lift level, can be an input to the software application for computation of a hair treatment modality that would be expected to work to produce the desired lift level in view of the hair characteristics.

In embodiments, the computed hair treatment modality can be associated with a confidence score that can be a parameter in the computation of a frequency of pause points in the treatment process. For example, a lower confidence score for a hair treatment modality, indicative of a lower certainty in the projected effectiveness of the hair treatment, can weigh toward a higher frequency of pause points in the treatment modality, while a higher confidence score for the hair treatment modality, indicative of a higher certainty in the projected effectiveness of the hair treatment, can weigh toward a lower frequency of pause points in the treatment modality.

In embodiments, the hair treatment modality 7, an output of the software application, is communicated to a user or individual by way of a communication with the system or a device thereof. In embodiments, the communication of the treatment modality can comprise transmitting, from the computational device (e.g., mobile device), one or more parameters of the treatment modality to the formulation delivery device for control of operation of the formulation delivery device, for example, treatment time, pause time, hair color or bleach selection, the identity of one or more cartridges that can be used to achieve the treatment modality, and the like. In embodiments, communication of the treatment modality can comprise displaying, with the computational device (e.g., a software application GUI as displayed by a smartphone touchscreen), steps for applying and monitoring the treatment progress with the treatment modality. The hair treatment modality can comprise a sequence of application steps, a mix ratio of a plurality of formulas of the cosmetic composition, a treatment time, a pause time, a stop time, a hair wetness level, or any combination thereof.

Accordingly, in embodiments, circuitry of the system is configured to compute a mix ratio of a plurality of formulas of the cosmetic composition and control an amount of a bleach formula and an amount of a developer formula that are mixed together by the formulation delivery device. In embodiments, a mix ratio of a plurality of formulas of the cosmetic composition, and a treatment time, are computed by circuitry of the system for avoidance of an inadvertent overapplication and/or underapplication of the cosmetic composition to the hair of the individual by a user via the formulation delivery device.

Since the process can be iterative in parallel with the application process, as shown at FIG. 3A, with loopback connections from the application of the bleach formula 8 to the computer vision analysis 2 and the self-analysis 3, the hair treatment modality 7 can be computed and then recomputed during the treatment process to more precisely and/or accurately apply the cosmetic composition to the hair with corrections made based on the treatment progress. In embodiments, a re-computed treatment modality can be mostly or completely the same as a previously-computed treatment modality, or can be different. For example, if the hair is responding faster to the treatment than expected, and is lightening (e.g., with a bleaching composition) faster than expected in view of the initial hair data set, the re-computed treatment modality can comprise one or more adjustments to one or more parameters of the hair treatment modality that result in a slowing and/or increased monitoring of the bleaching process. Such adjustments can include, for example, a dilution of the composition with a carrier, a change in the mix ratio of the bleach formula to the developer formula, a reduction in the remaining treatment time or an amount of treatment time left before a subsequent pause point, or the like. On the other hand, if the hair is responding to the treatment time essentially as expected, the re-computed treatment modality can be at least mostly the same as the previously-computed treatment modality, indicating the user should continue with the treatment without changes in the treatment modality.

Accordingly, in various aspects, the disclosure provides a system configured to facilitate a time-sensitive application of a cosmetic composition to hair of an individual with a formulation delivery device. The system comprises circuitry configured to receive an initial hair data set and compute, based on the initial hair data set, an initial shade of the hair of the individual. The circuitry is configured to receive a desired hair data set and compute, based on the desired hair data set, a desired shade of the hair of the individual and compute, based on the initial shade and the desired shade, a hair treatment modality configured to at least approximately achieve the desired shade with the time-sensitive application.

An in-progress hair data set, captured at a pause time of the treatment process, can be used by the system to evaluate progress of the application process. As such, in embodiments, the circuitry is also configured to receive an in-progress hair data set and recompute, based on the in-progress hair data set and the desired shade, the hair treatment modality. In embodiments, the in-progress hair data set comprises an in-progress user input that corresponds to a human-mediated visual inspection of an image of the hair of the individual generated at a pause time of the hair treatment modality, and a human-mediated comparison of the image of the hair of the individual generated at the pause time with imagery that corresponds to a plurality of reference shades. In these and other embodiments, circuitry is configured to recompute, based on the in-progress user input, the hair treatment modality.

In embodiments, the in-progress hair data set comprises an in-progress computational input that corresponds to a computational visual inspection of an image of the hair of the individual generated at a pause time of the hair treatment modality, e.g., as provided by a computational device, and a computational comparison of the image of the hair of the individual generated at the pause time with imagery that corresponds to a plurality of reference shades. In these and other embodiments, circuitry is configured to recompute, based on the in-progress computational input, the hair treatment modality.

In embodiments, the cosmetic composition is a hair bleach composition, a hair color composition, or both; however, other hair compositions can be implemented without departing from the scope and spirit of the disclosure.

In addition, in various embodiments, circuitry of the system can be configured according to any of various configurations and/or device topologies. For example, circuitry can be comprised within one computational device, or within a plurality of computational devices that can comprise, in embodiments, the formulation delivery device and a smartphone device, for example. In embodiments of the system comprising two or more computational devices, the devices can be configured for communication therebetween for coordination of the application process as well as monitoring of progress, e.g., by exchanging information. Such communication can occur by way of wired or wireless communication protocols as described herein or equivalents thereof, or as known in the art for computational devices.

In embodiments, circuitry of the system comprises a machine learning model that is configured to compute and/or recompute the initial shade, the desired shade, the hair treatment modality, or any combination thereof.

Figure 3B:
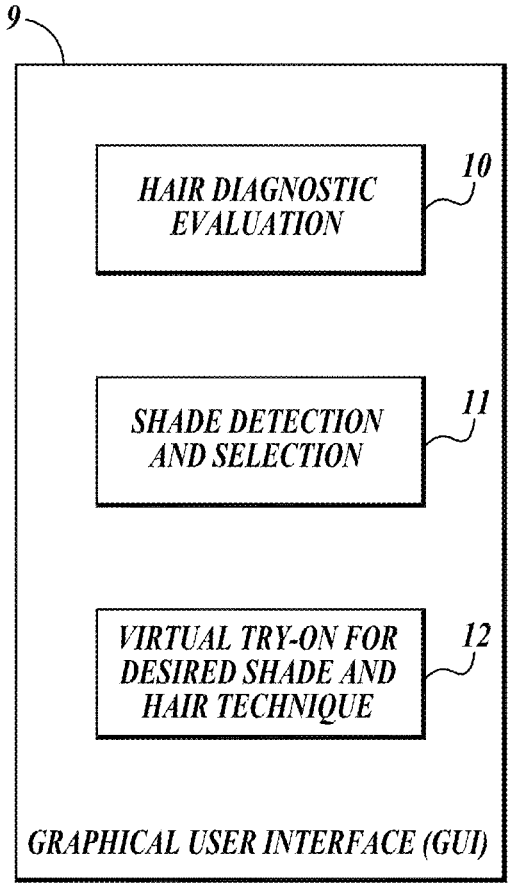
FIG. 3B shows a diagram of an example graphical user interface (GUI) of a system for a time-sensitive application of a cosmetic composition, or a computational device, according to aspects of the disclosure.

FIG. 3B shows a diagram of an example graphical user interface (GUI) of a system or device for a time-sensitive application of a cosmetic composition, according to aspects of the disclosure. In embodiments, circuitry of the system is configured to generate a graphical user interface (GUI) 9 that displays, on an image or a live video feed of the hair of the individual, an overlay of one or more optional shades on the image or the live video feed of the hair of the individual as a virtual try-on 12 of the one or more optional shades. In this manner, the individual can view what they can look like after the hair treatment. In embodiments, the GUI can display information related to hair characteristics resulting from diagnosis and/or evaluation 10, and/or information related to detection and selection of hair shades. The GUI can be displayed by a mobile phone of the individual, another computational device of the individual, or the formulation delivery device, for example, in various embodiments.

Figure 3C:
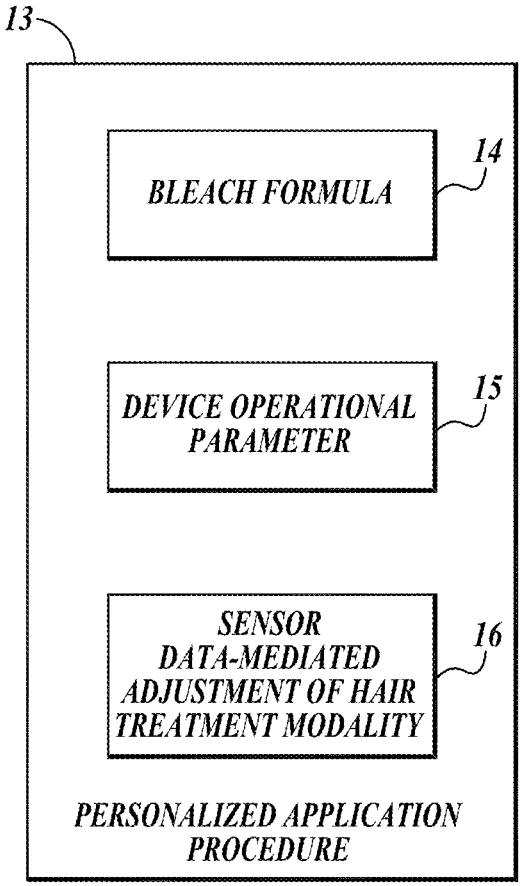
FIG. 3C shows a diagram of an example personalized application procedure of a system configured to facilitate a time-sensitive application of a cosmetic composition, according to aspects of the disclosure.

FIG. 3C shows a diagram of an example personalized application procedure of a system configured to facilitate a time-sensitive application of a cosmetic composition, according to aspects of the disclosure. The personalized application procedure 13 can convey information about a bleach formula 14 that would be functional to produce a desired hair shade with use of a particular hair treatment modality. Further, the personalized application procedure 13 can adapt the hair treatment modality, based on available hair color cartridges and/or available time for the application process, and adjust device operational parameters 15 accordingly. Such adjustments can include adjusting a mix ratio, a formula identity and/or concentration, an application time, and the like. As described herein, the personalized application procedure 13 can be adjusted based on sensor data 16 to stop, continue, speed up, or slow down the application process.

Figure 3D:
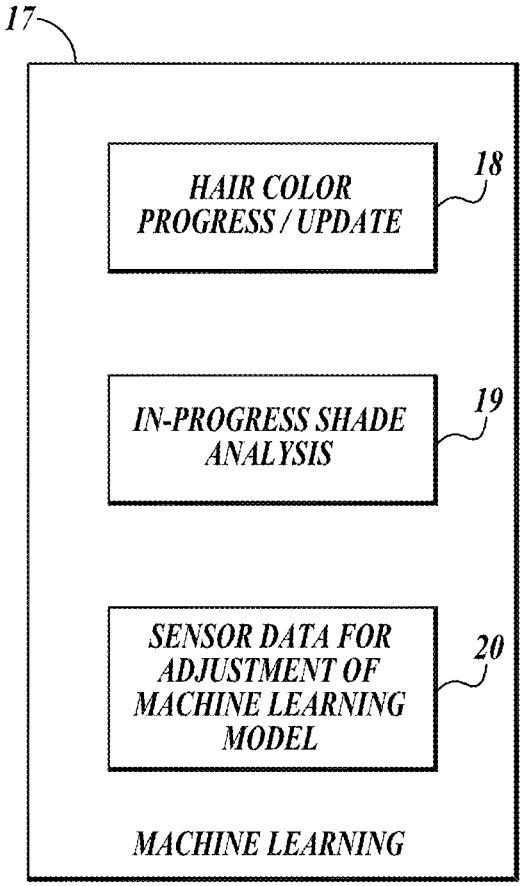
FIG. 3D shows a diagram of an example machine learning algorithm of a system configured to facilitate a time-sensitive application of a cosmetic composition, according to aspects of the disclosure.

FIG. 3D shows a diagram of an example machine learning algorithm of a system configured to facilitate a time-sensitive application of a cosmetic composition, according to aspects of the disclosure. In a general sense, machine learning 17 can be implemented, in embodiments, such that the system adapts to prior and ongoing hair treatments for improvements in accuracy and precision, and can learn from progress in hair coloring 18 as well as analysis of the shade of the hair 19, and sensor data 20 for adjustment of the machine learning model. For example, in embodiments, a machine learning component includes circuitry configured to implement image classification using artificial intelligence pattern recognition, image clustering, K-mean clustering, pixel-by-pixel analysis, k-Means cluster, c-Means clustering, ISODATA, and the like. In embodiments, a machine learning component includes circuitry configured to implement data augmentation techniques such as, for example, color adjustment, flipping, resizing, rotation, and the like. In embodiments, a machine learning component includes circuitry configured to execute one or more classification models. Non-limiting examples of classification models includes decision trees, logistic regression, Naïve Bayes, neural networks, and random forest.

In embodiments, a predictive analytics component includes one or more clustering models. Non limiting examples of clustering models include Density-Based Spatial Clustering of Applications with Noise (DBSCAN), Expectation-Maximization (E M) employing Gaussian Mixture Models (GMM), hierarchical clustering, k-means clustering, mean-shift clustering, model-based clustering, and the like.

In embodiments, a machine learning component includes circuitry configured to execute one or more supervise learning protocols. Non-limiting examples of supervise learning protocols include Decision Trees, Linear Regression, Naive Bayes, Nearest Neighbor, Neural Networks, Support Vector Machines (SVM), and the like.

In embodiments, a machine learning component includes circuitry configured to execute one or more unsupervised learning protocols. Non-limiting examples of unsupervised learning protocols include k-means clustering, Association Rules, and the like.

In embodiments, a machine learning component includes circuitry configured to execute one or more semi-supervised learning protocols. Non-limiting examples of semi-supervised learning protocols include anomaly detection neural networks, image classifiers, and text classifiers, and the like.

In embodiments, a machine learning component includes circuitry configured to execute one or more reinforcement learning protocols. Non-limiting examples of reinforcement learning protocols include Deep Adversarial Networks, Q-Learning, Temporal Difference (TD), and the like.

In embodiments, a machine learning component includes circuitry configured to classify images, extract significant objects from an image, track objects in an image, identify objects, and the like.

In embodiments, a machine learning component includes circuitry configured to classify images, extract significant objects from an image, track objects in an image, identify objects, and the like using one or more machine learning algorithms. Non-limiting examples of machine learning models and algorithms include Decision tree, Deep Neural Networks, K-nearest neighbors (KNN), Logistic regression, Naive Bayes, Random Forest, Support Vector Machines (SVMs), Transfer learning, YOLO (You Only Look Once), YOLOv3 (You Only Look Once, Version 3), or the like. Further non-limiting examples of machine learning models and algorithms for image analysis include AlexNet, Bag of Features Model, Convolutional Neural Networks (CNNs), DenseNet, FastViT, Inception-v3 (GoogleNet), MetaCLIP, MobileNet V2, MobileNet, ResNet (Deep Residual Networks), VGG16 (Visual Geometry Group), Viola-Jones Algorithm, Xception, and the like.

FIGS. 4A-4E show an example plurality of reference shades, and GUIs showing steps of an example process 21 for personalized application of a cosmetic composition, including an example hair characterization for an initial hair data set, a desired shade of the hair, a pause time for rinsing and checking progress of hair coloring, an example in-progress status bar and recommended hair care after hair coloring is complete, and an example of control of a mix ratio of a plurality of formulas of the cosmetic composition, and a treatment time, for time-sensitive application of the cosmetic composition, according to aspects of the disclosure. A plurality of reference shades, as shown by way of an example at FIG. 4A, can be referenced by an individual and/or computationally referenced by a computational device, for identification of a starting shade of the hair and/or a desired shade of the hair after the treatment. A software application, e.g., a "Colorsonic" software application of a mobile device, can be used to capture imagery of the hair for computational detection of the starting hair shade. In addition, or as an alternative, a user can input the starting hair shade manually using the computational device.

Figure 4A:
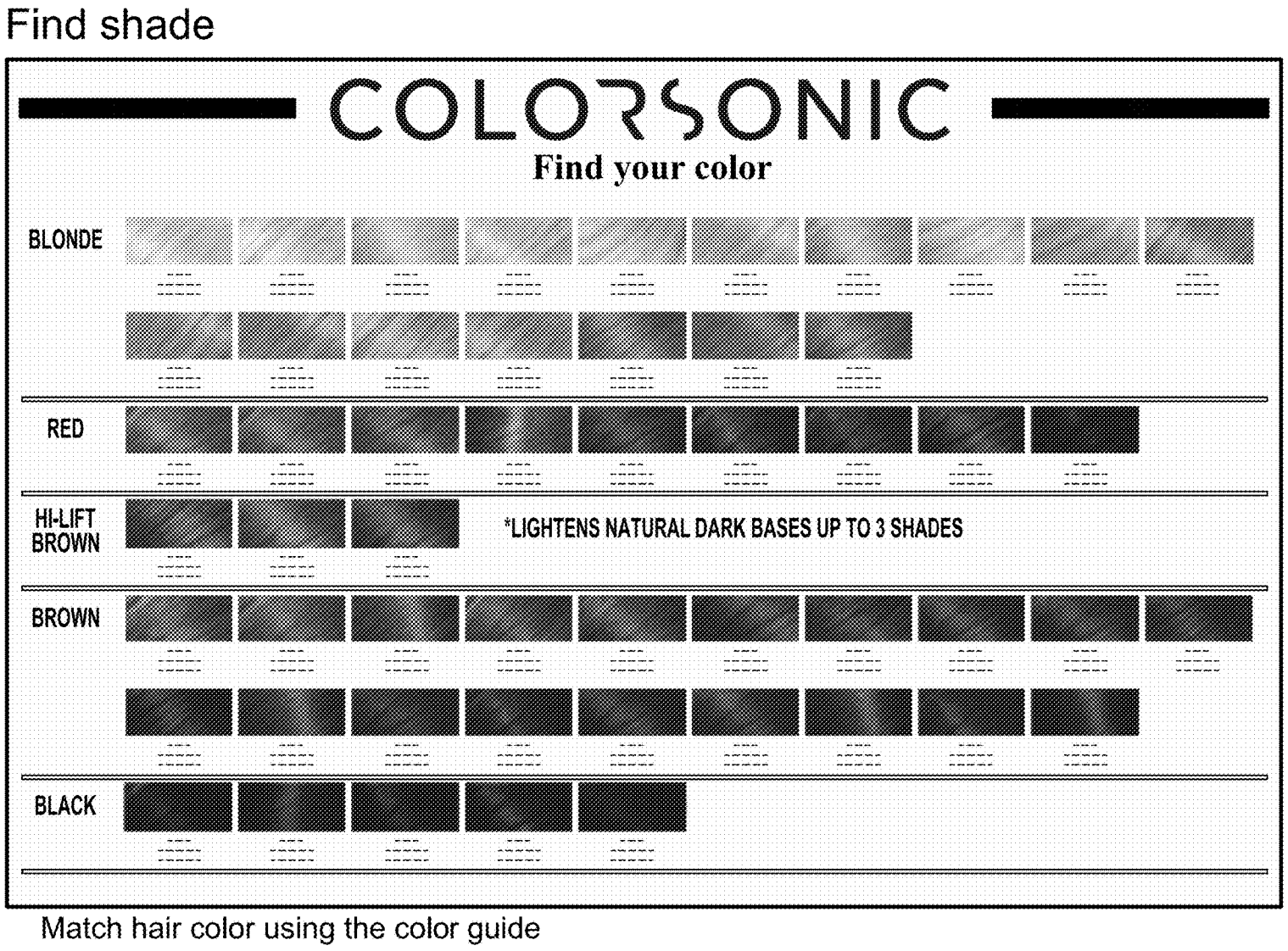
FIG. 4A shows an example plurality of reference shades, and GUIs showing steps of an example process for personalized application of a cosmetic composition, according to aspects of the disclosure.
Figure 4B:
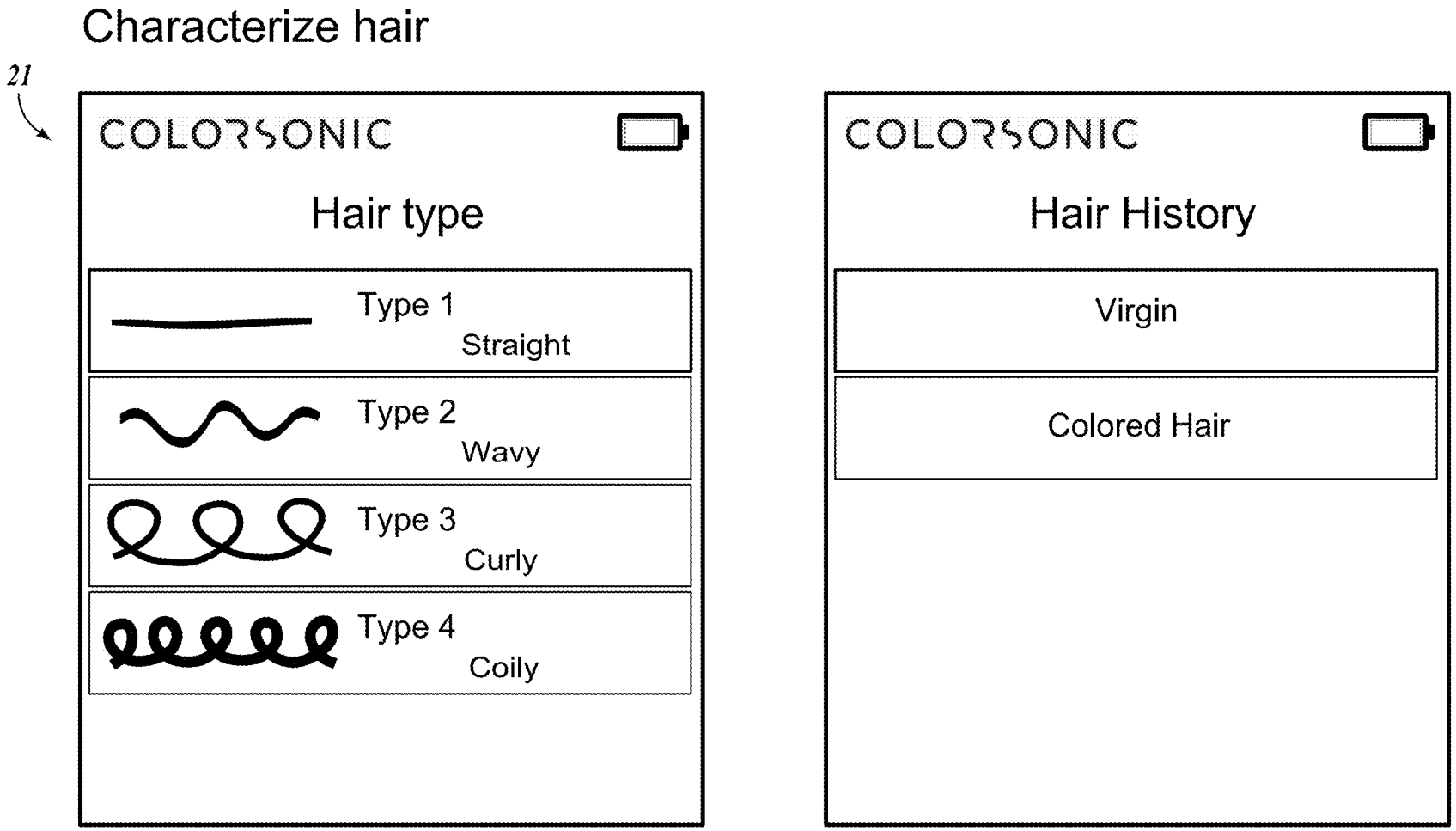
FIG. 4B shows an example hair characterization for an initial hair data set and a desired shade of the hair for personalized application of a cosmetic composition, as well as steps of an example process of applying the cosmetic composition to the hair of an individual, according to aspects of the disclosure.
Figure 4B:
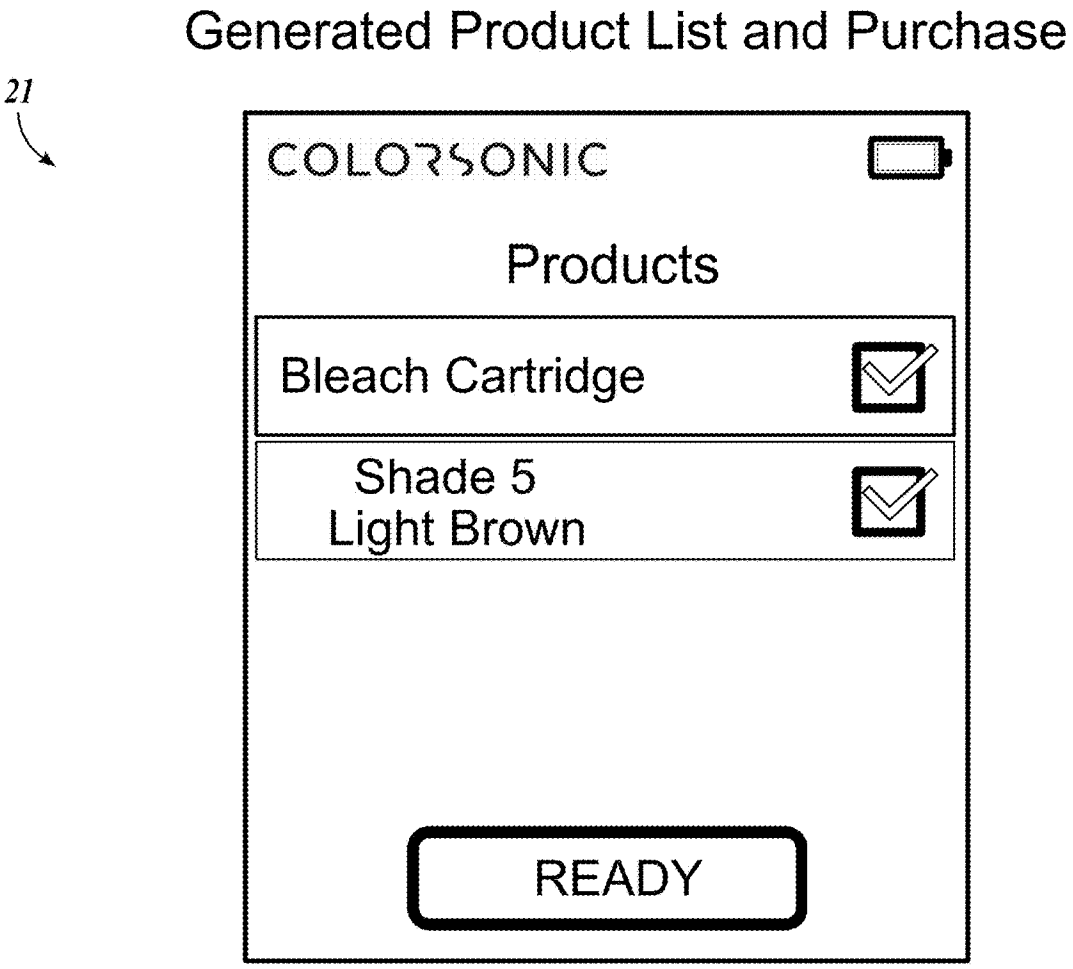
Figure 4B:
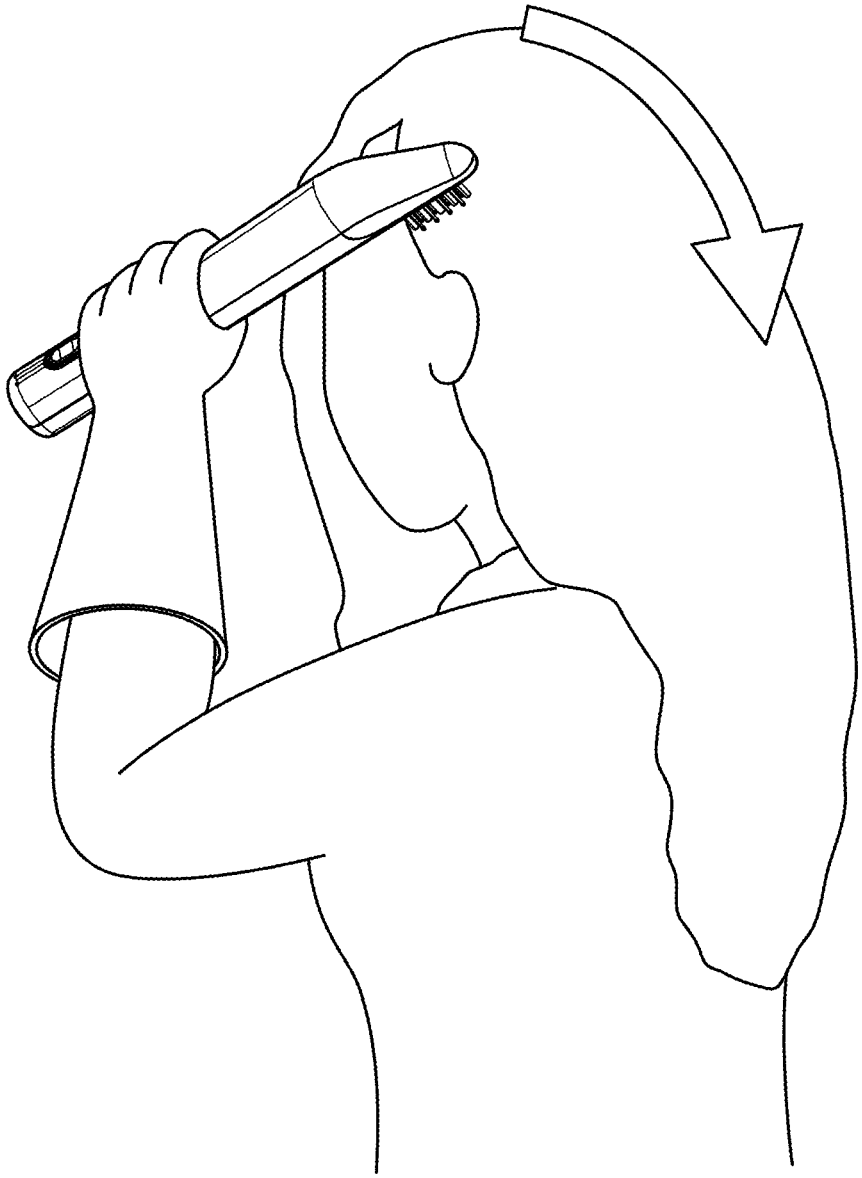

In embodiments, including as shown at FIG. 4B as a non-limiting example, the software and/or user can characterize the hair as a hair type, such as straight, wavy, curly, coily, and the like. A history of the hair can be input by a user, which can include whether the hair is currently colored (e.g., virgin: not colored; not-virgin: colored), and the like. Based on this and/or other information, the software application can recommend a product or provide a suggested product list to produce the desired hair shade, and can provide a purchasing interface to enable the user to purchase the desired cartridges with use of the mobile application.

In addition, in various embodiments, the software application can display, such as through a user interface or display of a computational device, a series of steps to follow to apply the cosmetic composition to the hair. For example, for a balayage treatment, the system can show a correct movement of the hand with the device to apply the composition to a portion of the hair, as shown at FIG. 4B as an example. Furthermore, in embodiments, the system can show more detailed steps for a hair treatment such as a balayage treatment, including where on the hair strands, relative to a part of the hair, to begin the highlights, as well as positioning and spacing information, as shown. The system can enable a user to select and/or view layouts for various hair treatments, including number of points (e.g., 1, 2, 3, as shown), or the like. Such instructional displays can occur with use of a visual interface, such as a graphical user interface or other graphical display, and can incorporate a step-by-step process directing use of the system for the hair treatment. In embodiments, such a visual interface can comprise a virtual-try-on, wherein hair to be treated (e.g., as part of a balayage) is indicated as an overlay of an image or live feed of the hair of the user, such that portions to receive the hair treatment appear differently than portions that are not to receive the hair treatment with the overlay; e.g., such portions can appear shaded, colored, or outlined, for example, indicating to a viewer that those portions of the hair should receive the hair treatment thereon.

Figure 4C:
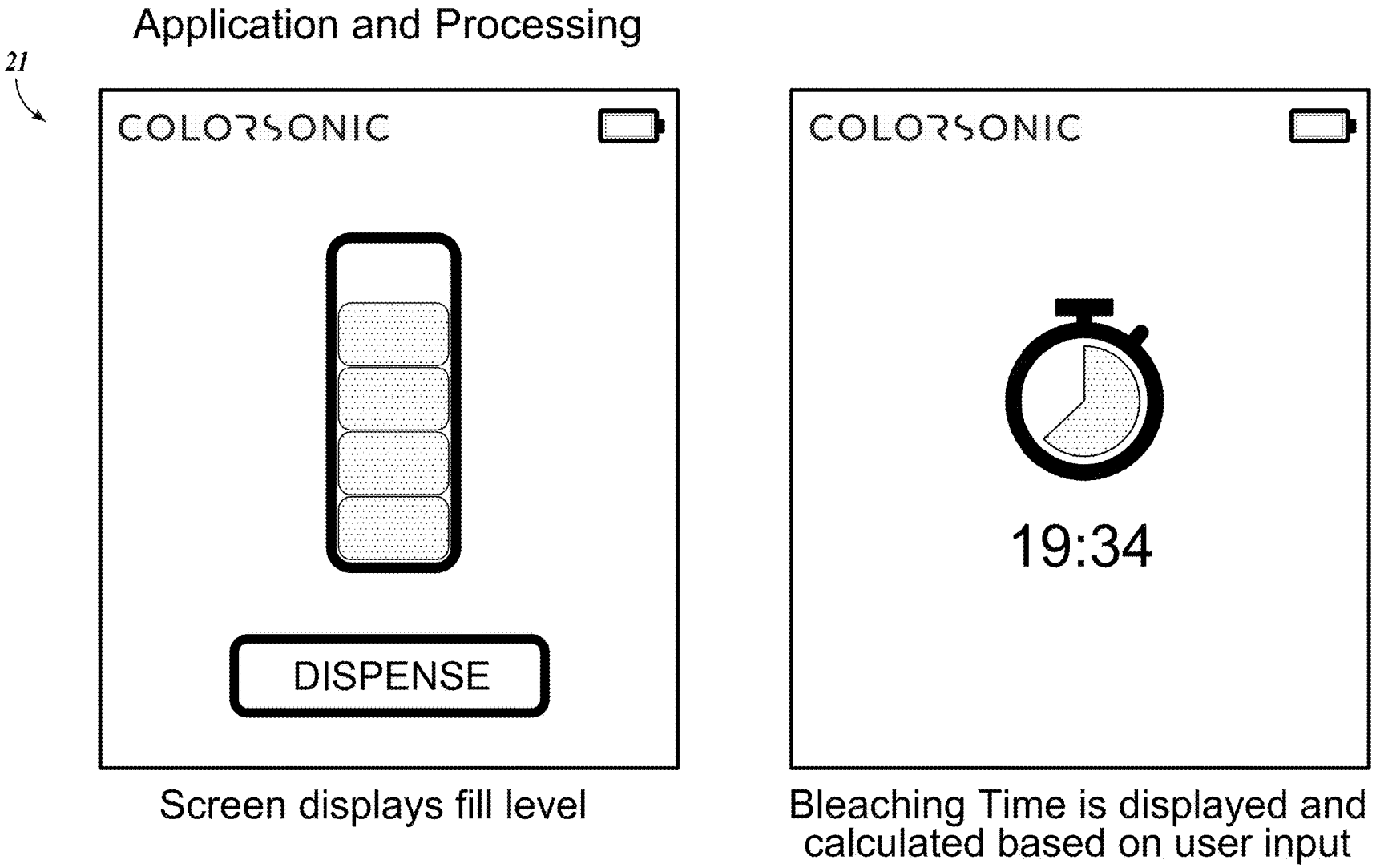
FIG. 4C shows an example personalized application of a cosmetic composition, with a pause time for rinsing and checking progress of hair coloring, according to aspects of the disclosure.
Figure 4C:
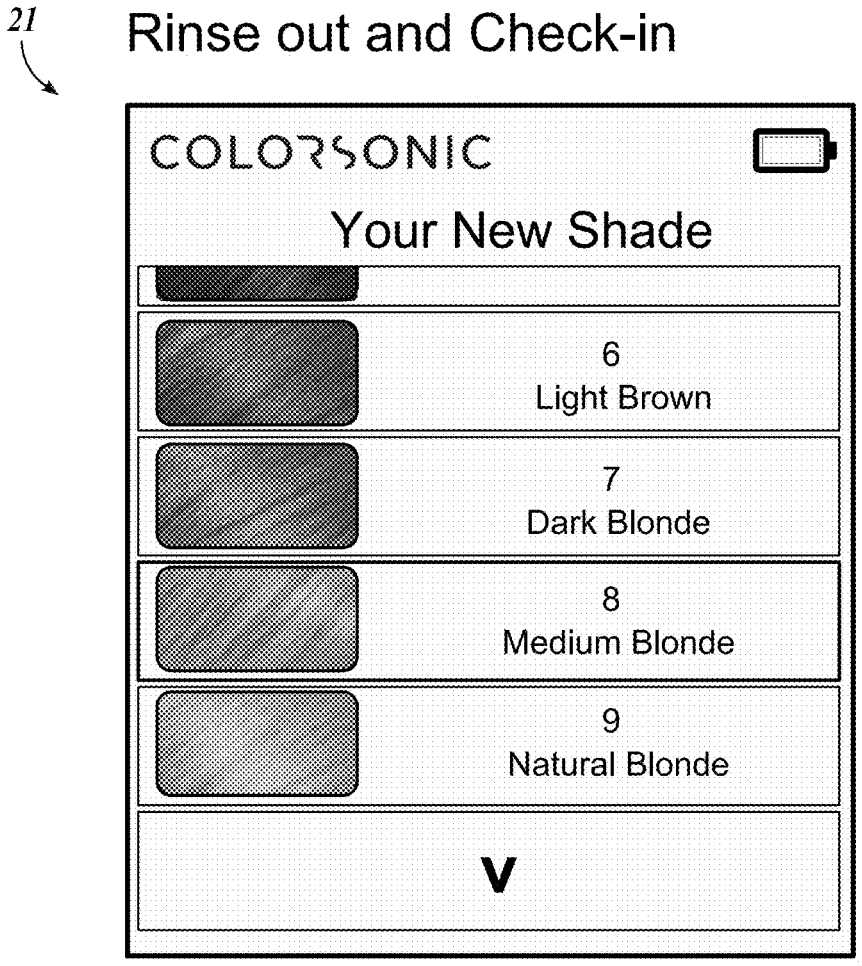

As shown at FIG. 4C, various parameters of device operation and the color process can be shown, with a display of the formulation delivery device and/or a display of another computational device, e.g., the user's smartphone. Such parameters can include, for example, battery charge level, fill level of cartridges, time lapsed and/or remaining in the bleaching process until a pause time or stop time, and the like. Once a pause time is reached, the system can display an indication for the user to rinse the individual's hair and perform a check-in to observe the progress of the hair coloring or bleaching process and obtain an in-progress hair data set.

Figure 4D:
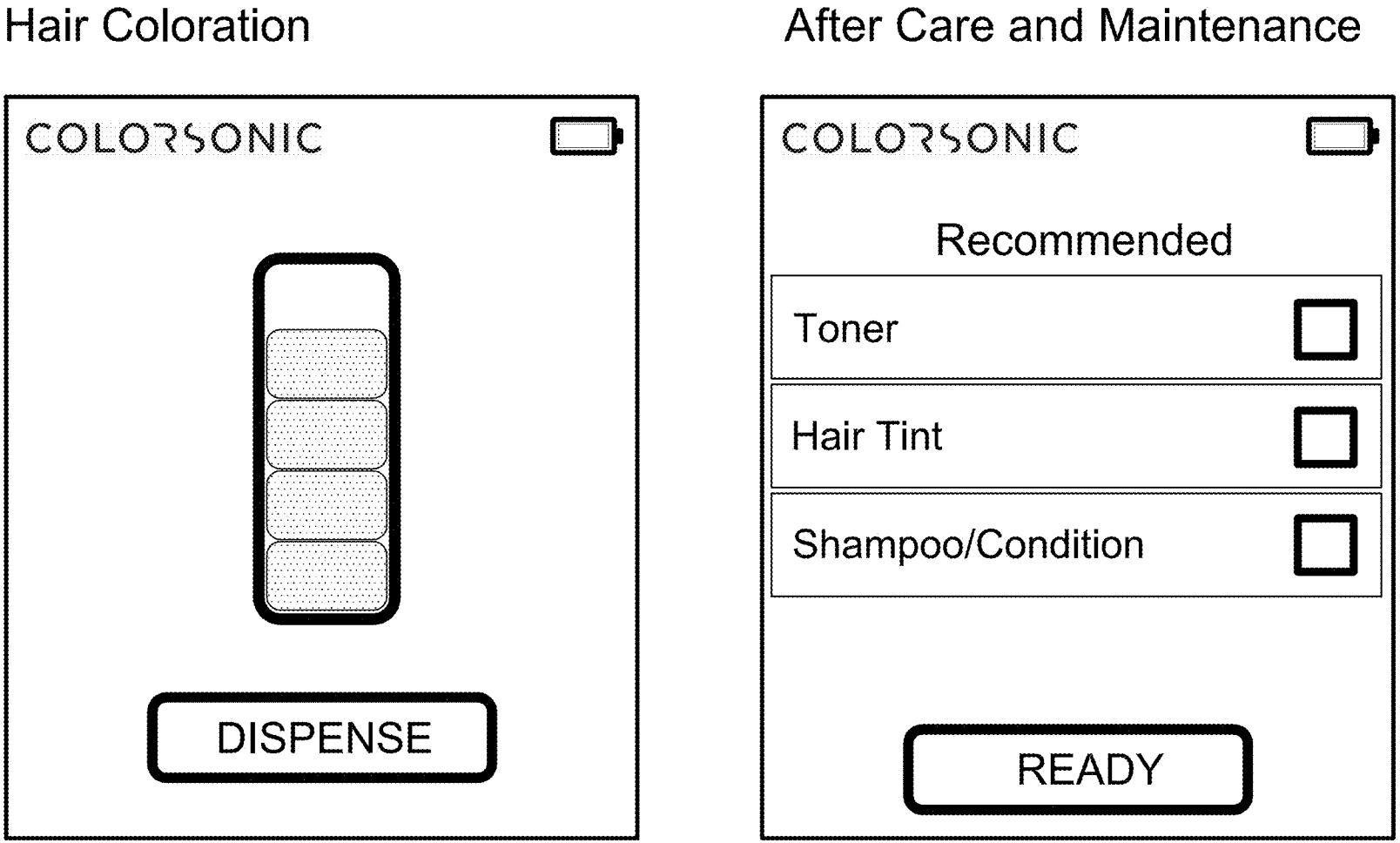
FIG. 4D shows an example in-progress status bar and recommended hair care after hair coloring is complete, according to aspects of the disclosure.

As shown at FIG. 4D, additional information about the device and/or application process can be shown by the system, such as a level of dispensation of the cosmetic composition, recommended hair treatments for after-care and maintenance, and the like. In this manner, the individual can care for their hair after the bleaching and/or coloring process to ensure the lift stays in the hair for a satisfactory period.

Figure 4E:
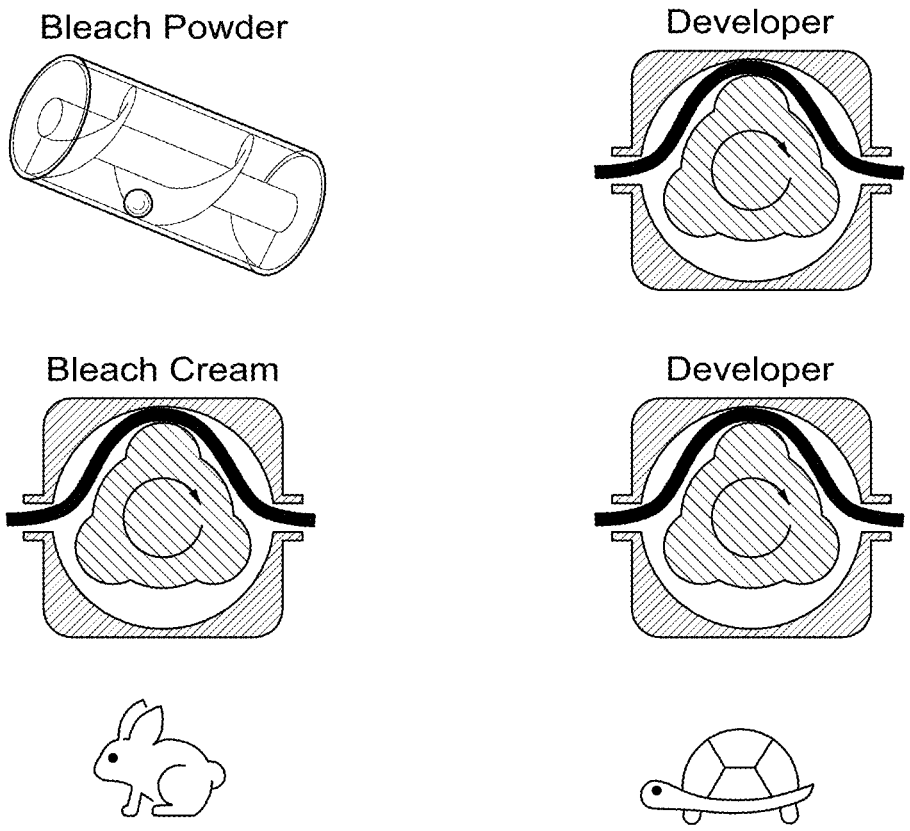
FIG. 4E shows an example for control of a mix ratio of a plurality of formulas of the cosmetic composition, and a treatment time, for time-sensitive application of the cosmetic composition, according to aspects of the disclosure.
Figure 4E:
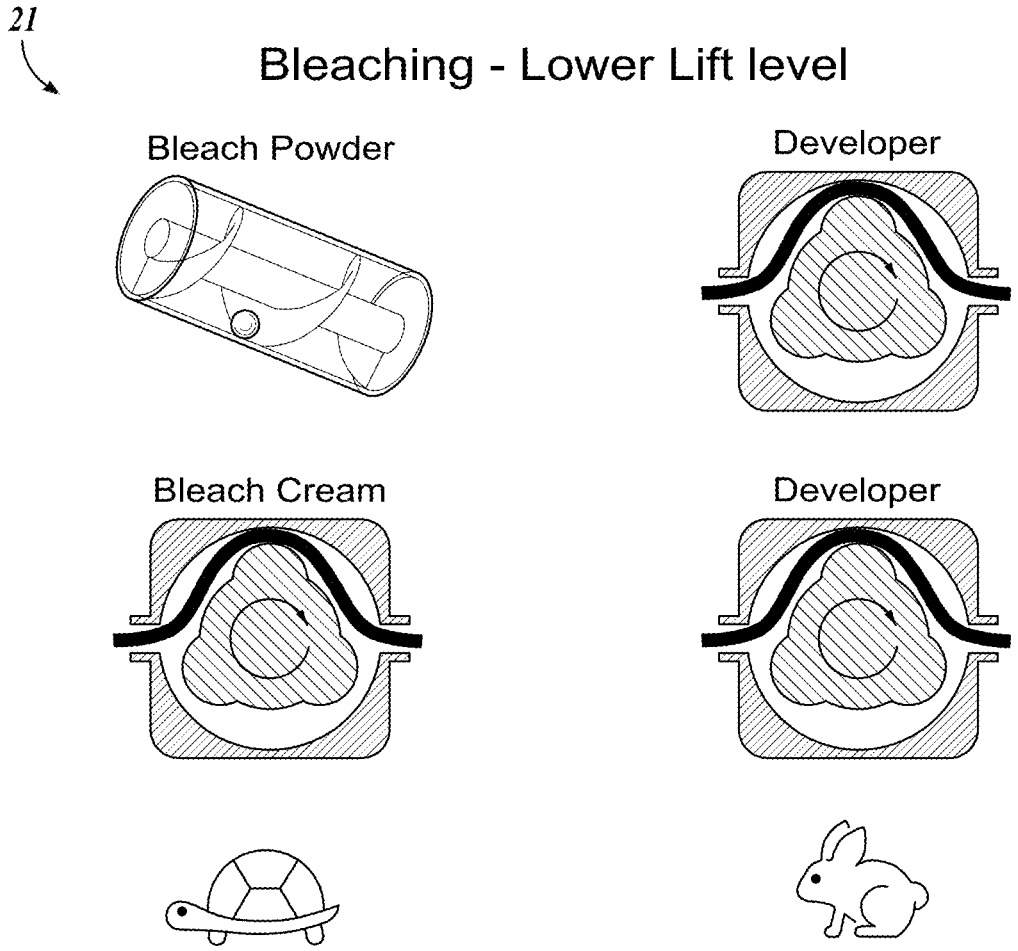

As shown at FIG. 4E, a mix ratio control mechanism can be included, as a component of the formulation delivery device, for controlled mixture of a bleach formula and a developer formula, and adjustment of a mix ratio of a hair treatment modality. This adjustment can be made before and/or during the application process, as a result of an in-progress hair data set, for example. By adjusting the mix ratio of the bleach formula and the developer formula, the hair bleaching process can be adjusted to increase or decrease the lift level for different desired hair shades and/or to better zero in on the desired hair shade during an application process.

In the claims and for purposes of the present disclosure, the terms "a", "an", "the", and the like, refer to the singular and the plural forms of the object or element referenced.

The present application may include references to directions, such as "vertical," "horizontal," "front," "rear," "left," "right," "top," and "bottom," etc. These references, and other similar references in the present application, are intended to assist in helping describe and understand the particular embodiment (such as when the embodiment is positioned for use) and are not intended to limit the present disclosure to these directions or locations.

The present application may also reference quantities and numbers. Unless specifically stated, such quantities and numbers are not to be considered restrictive, but exemplary of the possible quantities or numbers associated with the present application. Also in this regard, the present application may use the term "plurality" to reference a quantity or number. In this regard, the term "plurality" is meant to be any number that is more than one, for example, two, three, four, five, etc. The term "about," "approximately," etc., means plus or minus 5% of the stated value. The term "based upon" means "based at least partially upon."

As used herein, "system" and "computational system" refer to one or more computational devices that are configured for performing all or part of any method of the disclosure, in any order or sequence of steps, optionally in combination with one or more other computational devices that are configured for performing all or part of any method of the disclosure, in any order or sequence of steps. In at least some instances, a method can be performed by two or more computational devices that together form at least part of a computational system, and in such instances, the steps carried out by a first computational device can be complementary to the steps carried out by a second computational device. In other instances, a method can be performed by one computational device that forms at least part of a computational system.

As used herein, "computational device" refers to a physical hardware computing device that is configured for performing all or part of any method of the disclosure, in any order or sequence of steps, optionally with human input. In embodiments, circuitry of such a computational device is configurable with a processor and processor-executable instructions stored on a non-transitory machine-readable medium of the computational device, as a non-limiting example, but other approaches for configuring circuitry of the computational device can be implemented in embodiments. In embodiments, the computational device includes a processor for execution of instructions stored on a non-transitory machine-readable medium, for enabling the processor to carry out all or part of a method or process of the disclosure. Accordingly, in embodiments, a computational device includes a software application configured to perform all or part of one or more methods or processes of the disclosure, in any order or combination. However, in embodiments, a computational device includes dedicated hardware circuitry. Further configuration of circuitry of the computational device can include networking circuitry, for example, circuitry configured for a wireless connection, such as a Bluetooth® connection, a Bluetooth® low energy (BLE) connection, and/or a Wi-Fi® connection, and/or a wired connection. The networking circuitry, in combination with circuitry of the computational device, can be used to request, retrieve, and/or receive data from a remote server, for example. In embodiments, the circuitry can include operable connection of one or more sensors with the processor, or other circuitry, for performing logic operations and/or methods based on data received from the one or more sensors, for example.

While various types of computational devices useful for systems of the disclosure are discussed herein or are otherwise envisioned, an example computational device can be implemented as a device on a network. Examples can include servers, personal computers, mobile phones, smart phones, tablet computers, embedded computational devices, and other devices that can be used to implement portions of embodiments of the present disclosure. Embodiments of a computational device can be implemented in or can include an application-specific integrated circuit (ASIC), a field-programmable gate array (FPGA), or other customized device. Moreover, those of ordinary skill in the art and others will recognize that the computational device can be any one of any number of currently available or yet to be developed devices.

In its most basic configuration, a computational device includes at least one processor and a system memory connected by a communication bus. Depending on the exact configuration and type of device, the system memory can be volatile or nonvolatile memory, such as read only memory ("ROM"), random access memory ("RAM"), EEPROM, flash memory, or similar memory technology. Those of ordinary skill in the art and others will recognize that system memory typically stores data and/or program modules that are immediately accessible to and/or currently being operated on by the processor. In this regard, the processor can serve as a computational center of the computational device by supporting the execution of instructions.

A computational device can include a network interface comprising one or more components for communicating with other devices over a network. Embodiments of the present disclosure can access basic services that utilize the network interface to perform communications using common network protocols. The network interface can also include a wireless network interface configured to communicate via one or more wireless communication protocols, such as Wi-Fi, 2G, 3G, LTE, WiMAX, Bluetooth, Bluetooth low energy, and/or the like. As will be appreciated by one of ordinary skill in the art, the network interface can represent one or more wireless interfaces or physical communication interfaces described and illustrated above with respect to particular components of the computational device.

The computational device also includes a storage medium. However, services can be accessed using a computational device that does not include means for persisting data to a local storage medium. Therefore, the storage medium can be optional. In any event, the storage medium can be volatile or nonvolatile, removable or nonremovable, implemented using any technology capable of storing information such as, but not limited to, a hard drive, solid state drive, CD ROM, DVD, or other disk storage, magnetic cassettes, magnetic tape, magnetic disk storage, and/or the like.

Suitable implementations of computational devices that include a processor, system memory, communication bus, storage medium, and network interface are known and commercially available. For case of illustration and because it is not important for an understanding of the claimed subject matter, the disclosure does not show some of the typical components of many computational devices. In this regard, the computational device can include input devices, such as a keyboard, keypad, mouse, microphone, touch input device, touch screen, tablet, and/or the like. Such input devices can be coupled to the computational device by wired or wireless connections including RF, infrared, serial, parallel, Bluetooth, Bluetooth low energy, USB, or other suitable connections protocols using wireless or physical connections. Similarly, the computational device can also include output devices such as a display, speakers, printer, and the like. Since these devices are well known in the art, they are not illustrated or described further herein.

As used herein, "hair data set" refers to one or more characteristics of the hair of an individual that can be configured for use by a computational device or system to compute an initial shade of the hair, a desired shade of the hair, and/or a hair treatment modality to at least approximately achieve the desired shade. Non-limiting example characteristics of hair that can be at least part of a hair data set include initial, desired, and in-progress: hair length, hair thickness, hair type, hair color, hair shade, hair strand density, hair shape, degree of hair straightness or waviness or curliness, as well as a past responsiveness of the same or a similar hair to a hair treatment modality, or the like.

As used herein, "hair treatment modality" refers to a set of actionable conditions for carrying out a hair treatment (e.g., hair bleaching, hair coloring, or the like), such as the makeup and concentration of a cosmetic composition used for the hair treatment, a mix ratio of a bleach formula and a developer formula of the composition, a time that the composition is to be applied to the hair, the temporal positions of start points, pause points, and/or stop points within an application time period, or another such actionable condition.

As used herein, "user input" refers to one or more characteristics of the hair of an individual, provided by a user or another individual (e.g., manual input), to a computational device as a parameter for use by the computational device in the computation of an initial shade of the hair, a desired shade of the hair, and/or a hair treatment modality to at least approximately achieve the desired shade. Non-limiting example characteristics of hair that can be at least part of a hair data set include initial, desired, and in-progress: hair length, hair thickness, hair type, hair color, hair shade, hair strand density, hair shape, degree of hair straightness or waviness or curliness, as well as a past responsiveness of the same or a similar hair to a hair treatment modality, or the like.

The principles, example embodiments, and modes of operation of the present disclosure have been described in the foregoing description. However, aspects of the present disclosure, which are intended to be protected, are not to be construed as limited to the particular embodiments disclosed. Further, the embodiments described herein are to be regarded as illustrative rather than restrictive. It will be appreciated that variations and changes may be made by others, and equivalents employed, without departing from the spirit of the present disclosure. Accordingly, it is expressly intended that all such variations, changes, and equivalents fall within the spirit and scope of the present disclosure as claimed.

Non-Limiting Embodiments

While general features of the disclosure are described and shown and particular features of the disclosure are set forth in the claims, the following non-limiting embodiments relate to features, and combinations of features, that are explicitly envisioned as being part of the disclosure. The following non-limiting Embodiments contain elements that are modular and can be combined with each other in any number, order, or combination to form a new non-limiting Embodiment, which can itself be further combined with other non-limiting Embodiments.

Embodiment 1. A system configured to facilitate a time-sensitive application of a cosmetic composition to hair of an individual with a formulation delivery device, the system comprising circuitry configured to: receive an initial hair data set and compute, based on the initial hair data set, an initial shade of the hair of the individual; receive a desired hair data set and compute, based on the desired hair data set, a desired shade of the hair of the individual and compute, based on the initial shade and the desired shade, a hair treatment modality configured to at least approximately achieve the desired shade with the time-sensitive application; and receive an in-progress hair data set and recompute, based on the in-progress hair data set and the desired shade, the hair treatment modality.

Embodiment 2. The system of Embodiment 1 or any other Embodiment, wherein the cosmetic composition is a hair bleach composition, a hair color composition, or both.

Embodiment 3. The system of any one of Embodiments 1-2 or any other Embodiment, wherein the circuitry is comprised within one computational device.

Embodiment 4. The system of any one of Embodiments 1-3 or any other Embodiment, wherein the circuitry is comprised within a plurality of computational devices.

Embodiment 5. The system of any one of Embodiments 1-4 or any other Embodiment, wherein the plurality of computational devices comprises the formulation delivery device and a smartphone device.

Embodiment 6. The system of any one of Embodiments 1-5 or any other Embodiment, wherein the initial hair data set comprises an initial user input that corresponds to a human-mediated visual inspection of the hair of the individual and a human-mediated comparison of the hair with a plurality of reference shades, and wherein the circuitry is configured to compute, based on the initial user input, the initial shade.

Embodiment 7. The system of any one of Embodiments 1-6 or any other Embodiment, wherein the initial hair data set comprises an initial computational input that corresponds to a computational visual inspection of an image of the hair of the individual and a computational comparison of the image of the hair with imagery that corresponds to a plurality of reference shades, and wherein the circuitry is configured to compute, based on the initial computational input, the initial shade.

Embodiment 8. The system of any one of Embodiments 1-7 or any other Embodiment, wherein the desired hair data set comprises a selected user input that corresponds to a human-mediated selection of at least one reference shade of a plurality of reference shades, and wherein the circuitry is configured to compute, based on the selected user input, the desired shade.

Embodiment 9. The system of any one of Embodiments 1-8 or any other Embodiment, wherein the hair treatment modality comprises: a sequence of application steps, a mix ratio of a plurality of formulas of the cosmetic composition, a treatment time, a pause time, a stop time, a hair wetness level, or any combination thereof, wherein the system is configured to display at least a portion of the hair treatment modality for viewing.

Embodiment 10. The system of any one of Embodiments 1-9 or any other Embodiment, wherein the in-progress hair data set comprises an in-progress user input that corresponds to a human-mediated visual inspection of an image of the hair of the individual generated at a pause time of the hair treatment modality, and a human-mediated comparison of the image of the hair of the individual generated at the pause time with imagery that corresponds to a plurality of reference shades, and wherein the circuitry is configured to recompute, based on the in-progress user input, the hair treatment modality.

Embodiment 11. The system of any one of Embodiments 1-10 or any other Embodiment, wherein the in-progress hair data set comprises an in-progress computational input that corresponds to a computational visual inspection of an image of the hair of the individual generated at a pause time of the hair treatment modality, and a computational comparison of the image of the hair of the individual generated at the pause time with imagery that corresponds to a plurality of reference shades, and wherein the circuitry is configured to recompute, based on the in-progress computational input, the hair treatment modality.

Embodiment 12. The system of any one of Embodiments 1-11 or any other Embodiment, wherein circuitry of the system comprises a machine learning model that is configured to compute and/or recompute the initial shade, the desired shade, the hair treatment modality, or any combination thereof.

Embodiment 13. The system of any one of Embodiments 1-12 or any other Embodiment, wherein circuitry of the system is configured to generate a graphical user interface (GUI) that displays, on an image or a live video feed of the hair of the individual, an overlay of one or more optional shades on the image or the live video feed of the hair of the individual as a virtual try-on of the one or more optional shades.

Embodiment 14. The system of any one of Embodiments 1-13 or any other Embodiment, wherein circuitry of the system is configured to compute a mix ratio of a plurality of formulas of the cosmetic composition and control an amount of a bleach formula and an amount of a developer formula that are mixed together by the formulation delivery device.

Embodiment 15. The system of any one of Embodiments 1-14 or any other Embodiment, wherein a mix ratio of a plurality of formulas of the cosmetic composition, and a treatment time, are computed by circuitry of the system for avoidance of an inadvertent overapplication and/or underapplication of the cosmetic composition to the hair of the individual by a user via the formulation delivery device.

While illustrative embodiments have been illustrated and described, it will be appreciated that various changes can be made therein without departing from the spirit and scope of the disclosure.

The embodiments of the invention in which an exclusive property or privilege is claimed are defined as follows:

1. A method of hair treatment including time-sensitive application of a cosmetic composition to hair of an individual with a formulation delivery device, the method comprising:

receive, by the formulation delivery device, an initial hair data set;

compute, by circuitry of the formulation delivery device, an initial shade of the hair of the individual based on the initial hair data set;

receive, by the formulation delivery device, a desired hair data set;

compute, by the circuitry of the formulation delivery device, a desired shade of the hair of the individual based on the desired hair data set;

compute, by circuitry of the formulation delivery device, an initial state of a hair treatment modality configured to achieve the desired shade with the time-sensitive application based on a comparison between the initial shade of the hair and the desired shade of the hair;

initiate the hair treatment by applying the cosmetic composition to the hair of the individual with the formulation delivery device based on the initial state of the hair treatment modality;

pause the hair treatment at a pause time of the initial state of the hair treatment modality;

receive, by the formulation delivery device at the pause time partially through the time-sensitive application of the hair treatment, an in-progress hair data set;

compute, by the circuitry of the formulation delivery device, an in-progress shade of the hair of the individual based on the in-progress hair data set;

compute, by the circuitry of the formulation delivery device, an updated state of the hair treatment modality configured to achieve the desired shade with the time-sensitive application based on a comparison between the in-progress shade of the hair and the desired shade of the hair; and resume the hair treatment by applying the cosmetic composition to the hair of the individual with the formulation delivery device based on the updated state of the hair treatment modality.

2. The method of claim 1, wherein the cosmetic composition is a hair bleach composition, a hair color composition, or both.

3. The method of claim 1, wherein the circuitry is comprised within one computational device.

4. The method of claim 1, wherein the circuitry is comprised within a plurality of computational devices.

5. The method of claim 4, wherein the plurality of computational devices comprises the formulation delivery device and a smartphone device.

6. The method of claim 1, wherein the initial hair data set comprises an initial user input that corresponds to a human-mediated visual inspection of the hair of the individual and a human-mediated comparison of the hair with a plurality of reference shades, and wherein the circuitry is configured to compute, based on the initial user input, the initial shade.

7. The method of claim 1, wherein the initial hair data set comprises an initial computational input that corresponds to a computational visual inspection of an image of the hair of the individual and a computational comparison of the image of the hair with imagery that corresponds to a plurality of reference shades, and wherein the circuitry is configured to compute, based on the initial computational input, the initial shade.

8. The method of claim 1, wherein the desired hair data set comprises a selected user input that corresponds to a human-mediated selection of at least one reference shade of a plurality of reference shades, and wherein the circuitry is configured to compute, based on the selected user input, the desired shade.

9. The method of claim 1, wherein the initial state of the hair treatment modality comprises: a sequence of application steps; a mix ratio of a plurality of formulas of the cosmetic composition; a treatment time; the pause time; a stop time; a hair wetness level; or any combination thereof, wherein the system is configured to display at least a portion of the initial state of the hair treatment modality for viewing.

10. The method of claim 1, wherein the in-progress hair data set comprises an in-progress user input that corresponds to a human-mediated visual inspection of an image of the hair of the individual generated at a pause time of the initial state of the hair treatment modality, and a human-mediated comparison of the image of the hair of the individual generated at the pause time with imagery that corresponds to a plurality of reference shades, and wherein the circuitry is configured to recompute, based on the in-progress user input, the updated state of the hair treatment modality.

11. The method of claim 1, wherein the in-progress hair data set comprises an in-progress computational input that corresponds to a computational visual inspection of an image of the hair of the individual generated at the pause time of the initial state of the hair treatment modality, and a computational comparison of the image of the hair of the individual generated at the pause time with imagery that corresponds to a plurality of reference shades, and wherein the circuitry is configured to recompute, based on the in-progress computational input, the updated state of the hair treatment modality.

12. The method of claim 1, wherein circuitry of the system comprises a machine learning model that is configured to compute and/or recompute the initial shade, the desired shade, the initial state of the hair treatment modality, the updated state of the hair treatment modality, or any combination thereof.

13. The method of claim 1, wherein circuitry of the system is configured to generate a graphical user interface (GUI) that displays, on an image or a live video feed of the hair of the individual, an overlay of one or more optional shades on the image or the live video feed of the hair of the individual as a virtual try-on of the one or more optional shades.

14. The method of claim 1, wherein circuitry of the system is configured to compute a mix ratio of a plurality of formulas of the cosmetic composition and control an amount of a bleach formula and an amount of a developer formula that are mixed together by the formulation delivery device.

15. The method of claim 14, wherein the mix ratio of the plurality of formulas of the cosmetic composition, and a treatment time, are computed by circuitry of the system for avoidance of an inadvertent overapplication and/or under-application of the cosmetic composition to the hair of the individual by a user via the formulation delivery device.

* * * * *